US007793604B2

(12) United States Patent
Keller

(10) Patent No.: US 7,793,604 B2
(45) Date of Patent: Sep. 14, 2010

(54) PLANING SAILBOARD

(76) Inventor: John H. Keller, 4 N. End, Newburgh, NY (US) 12550

( * ) Notice: Subject to any disclaimer, the term of this patent is extended or adjusted under 35 U.S.C. 154(b) by 415 days.

(21) Appl. No.: 10/157,875

(22) Filed: May 31, 2002

(65) Prior Publication Data

US 2003/0003825 A1 Jan. 2, 2003

Related U.S. Application Data

(63) Continuation-in-part of application No. 09/867,437, filed on May 31, 2001, now Pat. No. 6,595,151.

(51) Int. Cl.
*B63B 35/79* (2006.01)

(52) U.S. Cl. ..... 114/39.14

(58) Field of Classification Search ... 114/39.12–39.15, 114/271, 272, 62; 441/65, 74, 79; D21/769; D12/303
See application file for complete search history.

(56) References Cited

U.S. PATENT DOCUMENTS

| | | | | | |
|---|---|---|---|---|---|
| 3,289,227 | A | * | 12/1966 | Kelly, Jr. | 441/74 |
| 3,487,800 | A | * | 1/1970 | Drake et al. | 114/39.15 |
| 4,730,568 | A | * | 3/1988 | Campbell | 114/39.14 |
| 5,127,862 | A | * | 7/1992 | Pia | 441/79 |
| 5,402,743 | A | * | 4/1995 | Holderman | 114/62 |

FOREIGN PATENT DOCUMENTS

| | | | |
|---|---|---|---|
| DE | 3422406 | * | 12/1985 |
| DE | 4332216 | * | 6/1994 |
| EP | 0203885 | * | 12/1986 |
| JP | 3-14788 | * | 3/1991 |

OTHER PUBLICATIONS

Clive Boden and Angus Chater; "Windsurfing Funboard Handbook"; 1984; pp. 52-54.

* cited by examiner

*Primary Examiner*—Edwin Swinehart
(74) *Attorney, Agent, or Firm*—Whitham, Curtis, Christofferson & Cook, P.C

(57) ABSTRACT

High performance of a sailboard is achieved over a wider range of wind and water conditions by providing a hull having two or more planing surfaces which may differ in shape and/or aspect ratio. Drag due to suction at steps between planing surfaces is reduced by venting to the air. Cusp shaping of the respective planing surfaces can reduce and stabilize the angle of attack at the displacement/planing transition without causing fore-and-aft pitching effects known as porpoising. By confining water under the planing surfaces to reduce lateral outflow thereof through increased downward curvature of the bottom of the board, winglets, asymmetrical fins, fences and the like, the effective width and aspect ratio of the wetted area may be altered beyond that of the actual geometry of the planing surfaces to further increase lift and reduce drag while providing additional sources of lift at displacement, transitional and planing speeds. Steps and/or cambered shapes of the planing surface may be used to dramatically further reduce wetted area and further increase effective aspect ratio.

3 Claims, 18 Drawing Sheets

PLANING SAILBOARD

CROSS-REFERENCE TO RELATED APPLICATIONS

Figure 1A:
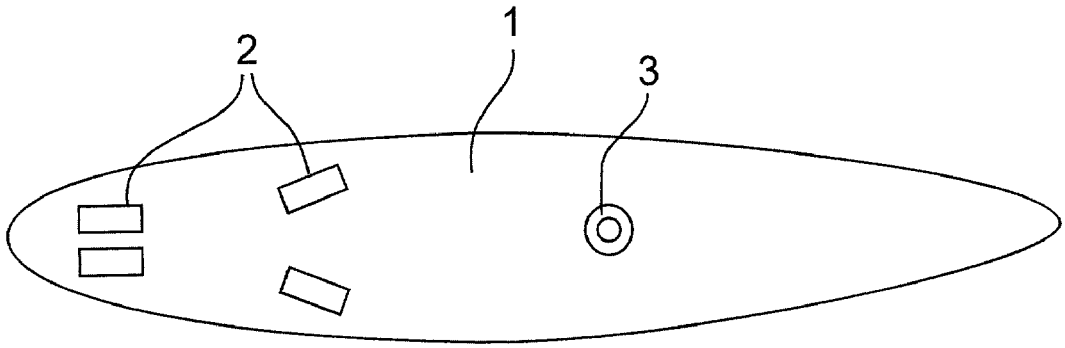

This is a continuation-in-part of U.S. patent application Ser. No. 09/867,437, filed May 31, 2001 now U.S. Pat. No. 6,595,151, hereby fully incorporated by reference, of which application, priority is hereby claimed as to all common subject matter.

BACKGROUND OF THE INVENTION

1. Field of the Invention

The present invention generally relates to planing hulls for watercraft and, more particularly, to planing hulls for sailboards/windsurfers for improving the transition from displacement operation to planing operation and exhibiting increased speed over a wider range of wind speed.

2. Description of the Prior Art

Hulls of watercraft may be of either of two distinct types: a displacement hull which derives vertical lift from the weight of water displaced by the hull and a planing hull which derives vertical lift from thrusting water downwardly by the bottom surface of the hull when in motion. At rest or at low speed, planning hulls function in the same manner as displacement hulls. Displacement hulls are most efficient and derive greatest speed for a given amount of power if they are a long and narrow, streamlined shape. Planing hulls, on the other hand can be much more efficient than displacement hulls when planing and, since lift is derived from the angle of attack between the bottom surface of the hull and the water surface, are most efficient if wide and short; directly conflicting with the preferred shape for displacement hulls.

Therefore, in general, the more fully a hull is optimized for planing efficiency, the more power is required to reach planing speed. It follows that planing hulls must often represent a compromise between efficiency in the displacement and planing modes of operation, particularly where available motive power is limited such as when sails are employed. Conversely, wind/sail-powered watercraft such as sailboards generally operate well only within a narrow range of wind conditions.

More specifically, the area ratio or aspect ratio, AR, of a planing board relates the planing surface width to its length. The aspect ratio is given by $$AR=b^2/\text{area}=b/c$$

where "b" is the width of the planing surface, "area" is the planform area of the planing surface and "c" is the average length of the planing surface.

Narrow boards where the width of the planing part of the board is small, resulting in a small AR are generally thought to be faster than wider boards with a larger AR, possibly because they are more streamlined and easier to power at low speeds and achieve a more nearly optimum planing angle at high speeds even though the lift of the lower AR board may be only 60% to 70% of a board with twice the aspect ratio, AR, but the same area and planing angle. Once planing, however, a higher aspect ratio board can be faster either upwind or downwind.

For example, commercially available sailboards such as the Mistral Ultralight and the F2 race board are made for non-planing or marginal planing conditions and are long, narrow and streamlined but, as would be expected, do not plane well and are not as fast as planing "slalom" or short boards. For example, some boards like the commercially available Pro-Tech C. A. T. are wide and short and very fast when planing but comparatively slower at displacement operation speeds in light winds. Such short boards are also somewhat more difficult to control and "unfriendly" to inexperienced wind surfers. Other boards which are short and narrow are fast when planing because they achieve the proper attack or planing angle but require more wind to achieve planing.

Other factors in board design also affect performance in a variety of conditions, particularly in regard to planing. For example, if a board is flat, it will plane in lower wind but tends to ride "hard" under conditions of even a slight chop (e.g. wind driven small waves). If it is large so that it planes in low wind, it is not as fast in higher winds because it will assume too small an angle of attack. If the bottom of the board has a V-shape, it will ride more smoothly but will not plane as fast (e.g. requires more wind to achieve planing). The board will also ride more smoothly if it has more "rocker" (e.g. curvature front-to-rear). It will be faster when not planing and may be faster when planing in high wind due to reduction in wetted area. However, increased "rocker" makes it plane more slowly and requires additional wind for planing due to the decreased angle of attack at the rear which may even cause friction where the bottom surface tries to leave the water. Thus, increased rocker is generally desirable in displacement hulls while decreased, if any, rocker is desirable in planing hulls.

Commercially available boards which are designed primarily to perform in light wind are generally too flat to perform well in higher wind. Such boards are more flat and plane at an angle of attack less than the optimum 4°-7°; thus having increased wetted surface and associated drag.

In this regard, it is known for relatively small motor boats (having a significant degree of rocker) to install trim plates extending behind the transom or stern of the boat which can be deflected slightly downwardly to provide lift at the stern of the boat and thus increase the stern angle of attack when the hull is beginning to plane. The trim plates thus reduce power requirements and smooth the transition between displacement and planing modes of operation. However, it is not practical to use such expedients on a sailboard since control by the operator is impractical.

Further, for both boats and sailboards, such trim plates or hull shaping to the same purpose (which is effectively contrary to the function of rocker), if not properly set for the current speed, can cause an effect known as porpoising. Porpoising is an unstable state in which excess lift at the rear or stern forces the bow lower in the water where rocker causes increased lift at the bow; resulting in an oscillatory pitching action and increased drag. Moreover, with sailboards, some of the deleterious effects of excessive rocker, such as increased angle of attack can be ameliorated by alteration of fore and aft balance at the displacement/planing transition by a suitably skilled operator.

Planing hulls may also be of either the stepped or unstepped types. While the latter has a substantially continuous lower surface, the former, stepped type has an upward step or recess in the bottom surface which is either in front of the center of gravity or very small. This step, under planing conditions at relatively high speed, reduces the wetted surface and associated drag. However, the discontinuity in the shape of the bottom surface also tents to increase drag (for reasons that have not previously been well-understood but intuitively thought to be related to a combination of turbulence and suction behind the step and deeper extension into the water) during displacement mode operation and increase the difficulty of the transition between displacement and planing conditions as well as increasing the power/speed required to reach planing conditions.

Possibly for this reason, stepped bottom surfaces are not generally used for sailboards. Among currently commercially available designs, only the Pro-tech C. A. T., which has an approximately one-half inch step near the rear of the board, provides a stepped bottom surface rather than a single running or planing bottom surface. Further, the step is either completely surrounded by water (during displacement operation) so it only functions as a step in the mainly displacement mode (low speed planing or slower) or completely out of the water (during planing operation).

For a wing having flow across both the top and bottom surfaces, the effect of AR on the lift coefficient, $C_L$, has been determined by Prandtl in 1918 and by experiments to be $$C_L=1.8\pi(\alpha+\beta)/(1+2/AR)$$

where $\alpha$ is the angle of attack and $\beta$ is the wing curvature in the direction of the flow. Thus, it can be seen directly that a reduced aspect ratio reduces lift. Reduced aspect ratio also increases induced drag and reduces the lift to drag ratio. Trailing vortices which cause reduced lift and increased drag for low aspect ratio boards are easily observed and are similar to trailing vortices produced by a wing.

U.S. Pat. No. 5,823,480 to LaRoche and "Wing-grid, A Novel Device for Reduced Induced Drag on Wings" by LaRoche and Palfrey, Fluid Mechanics Laboratory HTL Bruggs-Windisch, CH-5200 Switzerland disclose winglets or a wing-grid (multiple short wings, possibly with free ends much like feathers of a bird, or a grille-work of airfoils much like a multiply slotted aircraft wing) can be used to increase the effective AR and thus reduce the trailing vortices and induced drag. Essentially, a so-called fence at the end of a wing or hydrofoil can increase the lift of the wing/hydrofoil and thus increase the effective aspect ratio of the wing/hydrofoil. However, these reported effects have been confined to environments providing flow on both surfaces and not with planing surfaces.

In summary, while numerous design features of watercraft hull shapes are known for enhancement of efficiency and performance, each such feature and most combinations thereof have tended to narrow the range of conditions under which such enhancement can be realized. These limitations are particularly critical where available power is limited as is the case with sailboards which operate solely under sail power and where the sail area is severely limited by the necessity of being held in place by a human operator, principally by balancing wind force with limited body weight.

Further, good planing performance is of high importance with sailboards since high speed is very desirable in the windsurfing sport and less power is required while planing, as alluded to above. Moreover, the speed increase which occurs when planing is achieved greatly increases apparent wind speed during reaches (sailing generally across or toward the wind), allowing substantial increase in the speed attainable as well as generally increased maneuverability. Nevertheless, known designs of sailboard hulls only support such levels of performance within a limited range of conditions (e.g. wind speed, water surface chop, and the like) while the cost and size of sailboards and other practical considerations effectively prevent alternative use of sailboards of different designs to exploit particular conditions which may prevail at any given time. To date, no single sailboard hull design has been proposed which provides desirable characteristics over a wide range of wind and water conditions, particularly providing stability and ease of control even in heavy winds and chop with the ability to achieve planing in very light wind (e.g. of about six miles per hour or less), to present low drag and high lift over a wide range of speeds and a smooth displacement to planing mode transition and to provide increased efficiency in both the displacement and planing modes of operation to provide higher speed in both modes for given wind speed, particularly by further increasing the effective aspect ratio when planing while maintaining a low physical aspect ratio for increased efficiency in the displacement mode.

SUMMARY OF THE INVENTION

It is therefore an object of the present invention to provide a hull design, particularly for a sailboard, which has high planing performance and can reach a planing mode of operation over a wide range of wind speed.

It is another object of the invention to provide a hull design which has a stable and consistent angle of attack when planing over a wide range of wind speed.

It is a further object of the invention to provide a sailboard hull having a stepped lower surface that reduces difficulty of the transition from displacement to planing operation and avoids other observed undesirable effects such as increased drag during displacement operation.

It is yet another object of the invention to provide a sailboard hull design which reduces the effect of small aspect ratios of a planing hull, particularly at planing speeds and provides an increased effective aspect ratio with correspondingly increased lift and reduced trailing vortices and correspondingly reduced induced drag.

In order to accomplish these and other objects of the invention, a sailboard apparatus and hull thereof having an arrangement for attaching foot straps and a sail mast attachment arrangement is provided including a downwardly curved or angled lower surface to reach a maximum transverse angle of 10° or greater at the edges such that the edges of the board are lower than the centerline of the board by at least three-quarters of an inch or 0.03 time the maximum width of the hull, whichever is less whereby the lift to drag ratio of the hull is increased. A portion of the curved or angled surface preferably includes at least one of a plurality of pairs of winglets, wing grids, a pair of asymmetric fins, a plurality of pairs of fins of symmetric or asymmetric form, spaced fences, a ventilated step, a surface having a downward curvature in a front to back direction and a cambered surface.

In accordance with a yet further aspect of the invention, a sailboard apparatus is provided having a hull, an arrangement for attaching foot straps including a front foot strap and a sail mast attachment arrangement, said sailboard hull having an effective width at a location between said sail mast attachment arrangement and said arrangement for attaching said front foot strap which is at least 2.0 times the width of the planing surface of said hull 30 cm from the rear of said hull.

BRIEF DESCRIPTIONS OF THE DRAWINGS

Figure 1B:
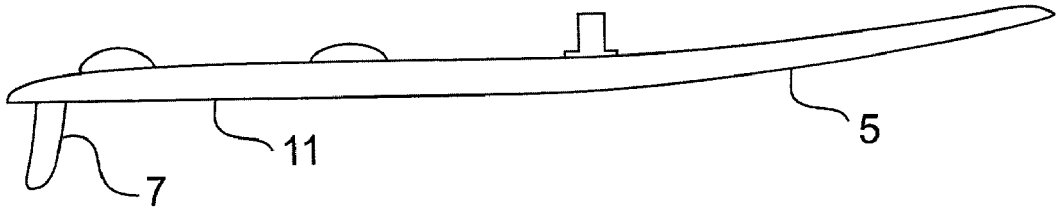
Figure 1C:
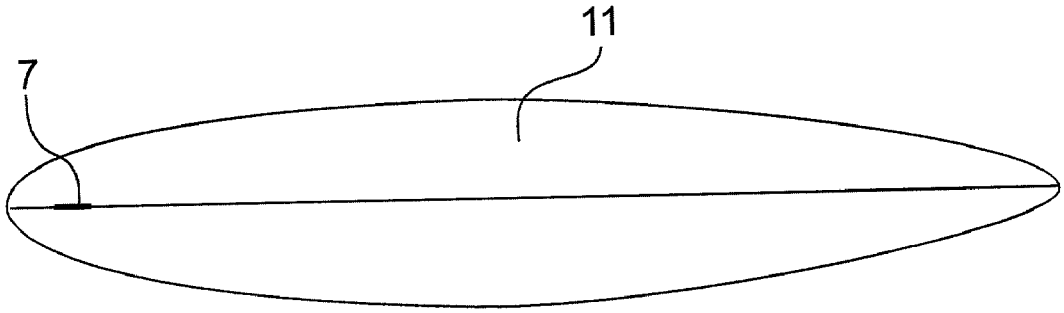
Figure 2A:
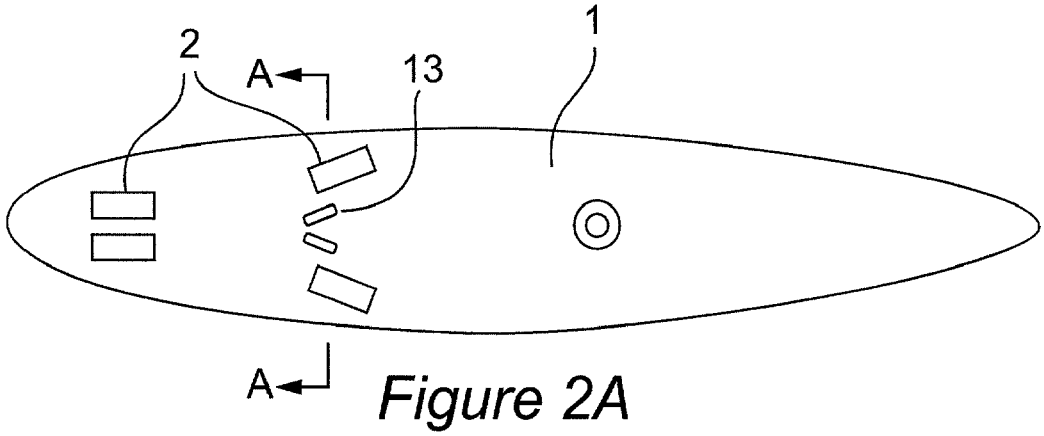
Figure 2B:
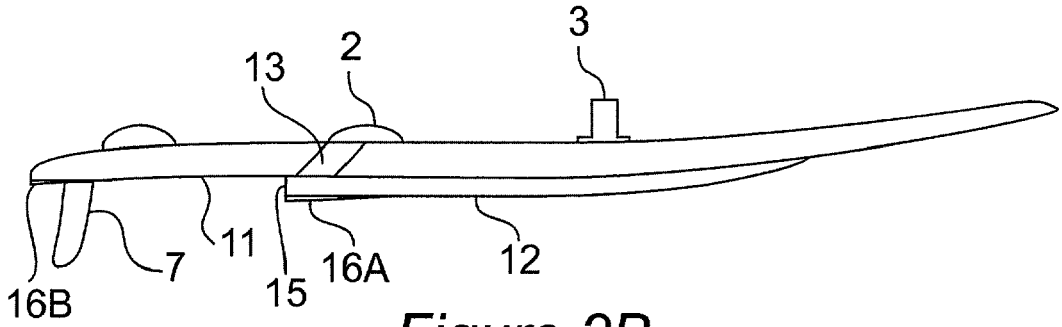
Figure 2C:
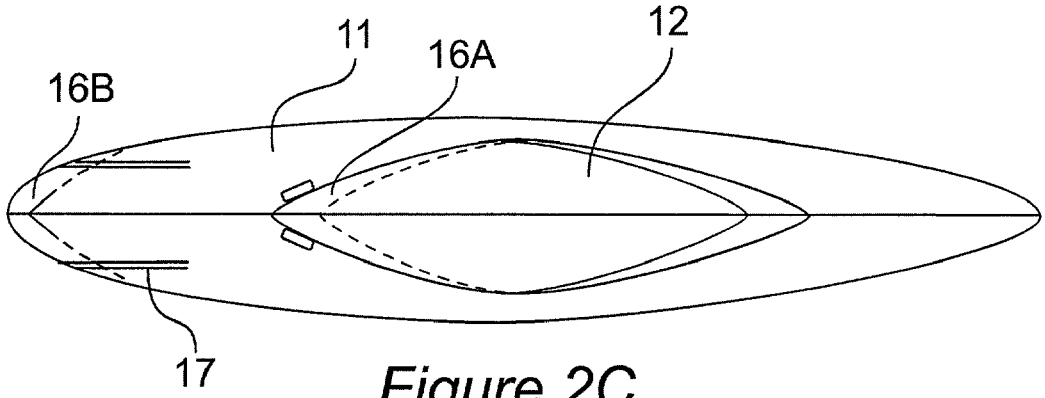
Figure 2D:
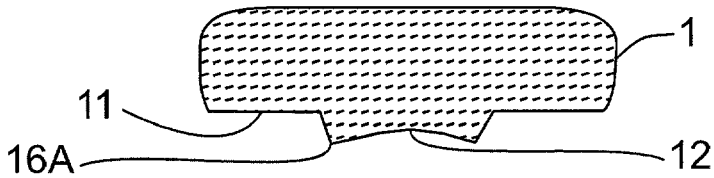
Figure 3A:
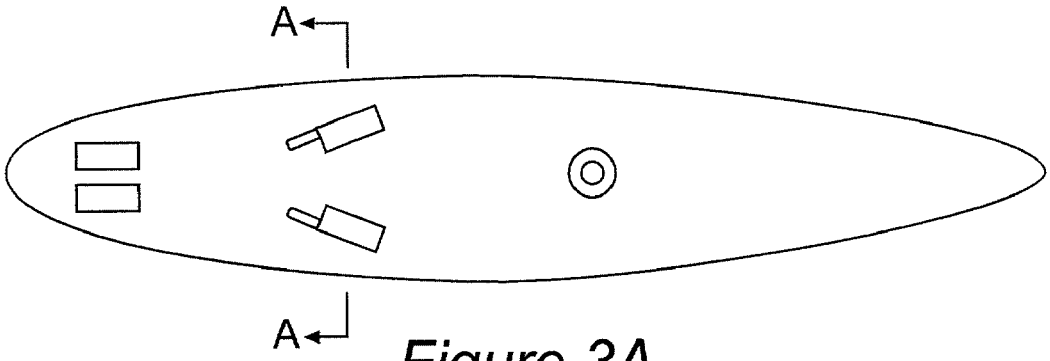
Figure 3B:
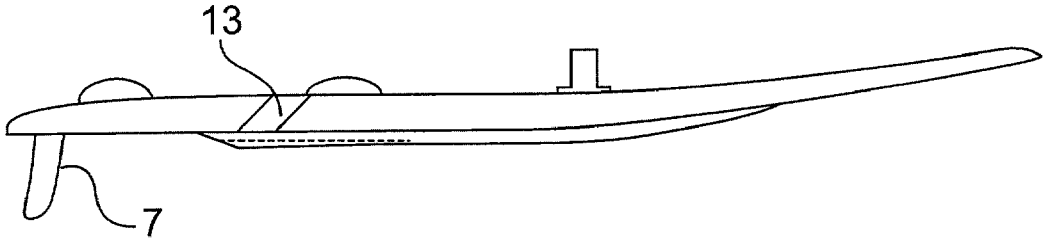
Figure 3C:
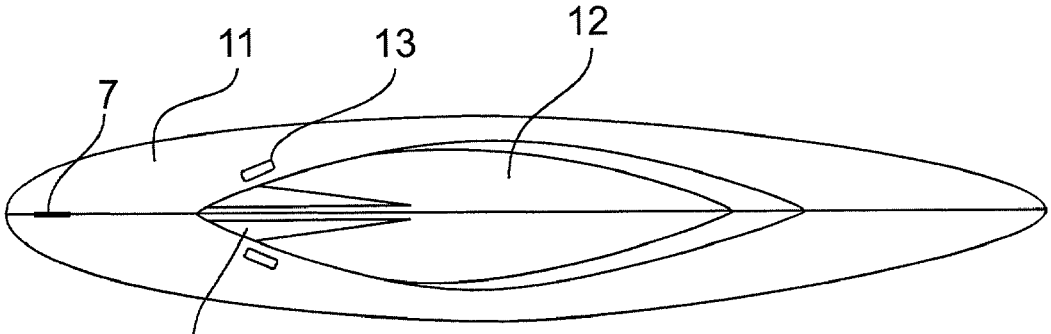
Figure 3D:
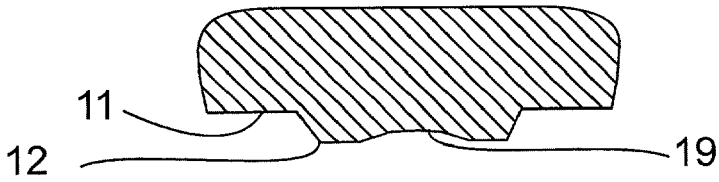
Figure 4A:
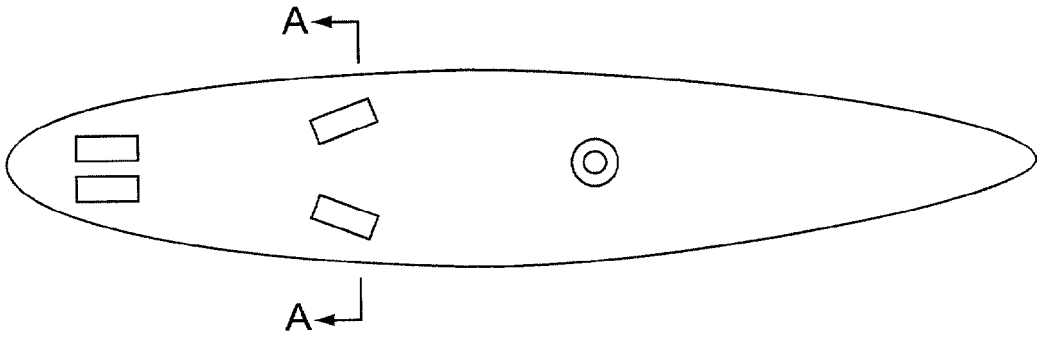
Figure 4B:
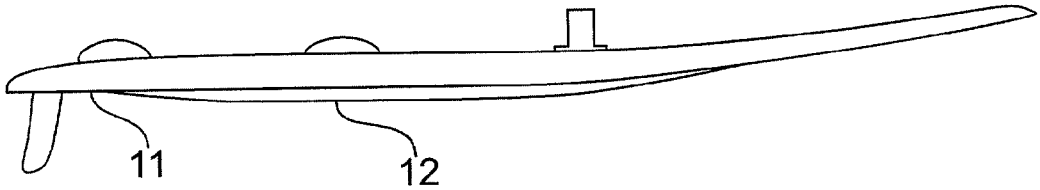
Figure 4C:
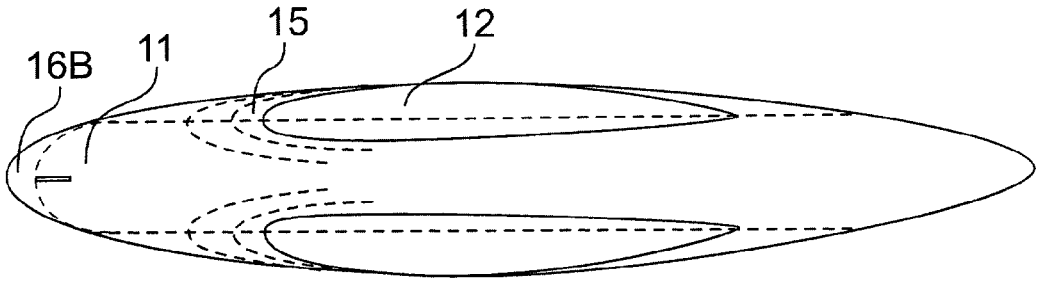
Figure 4D:
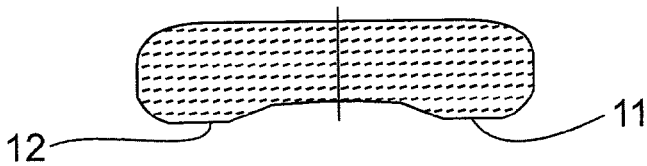
Figure 5A:
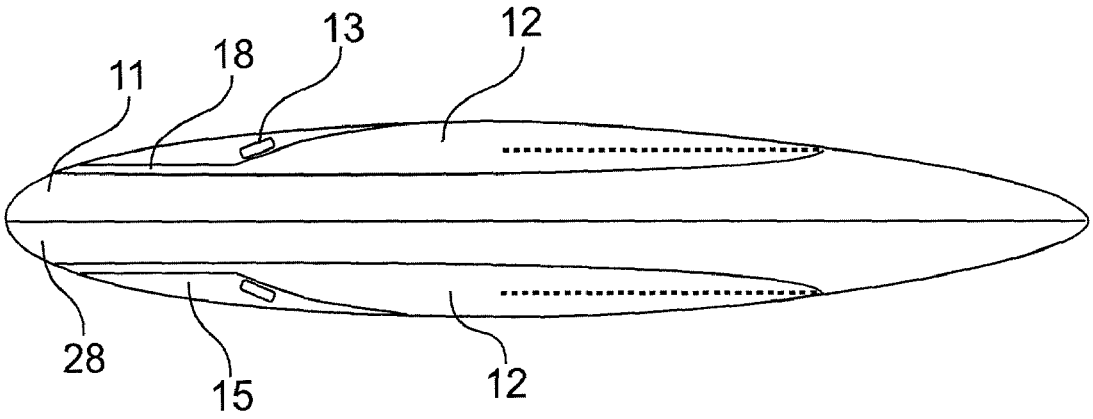
Figure 5B:
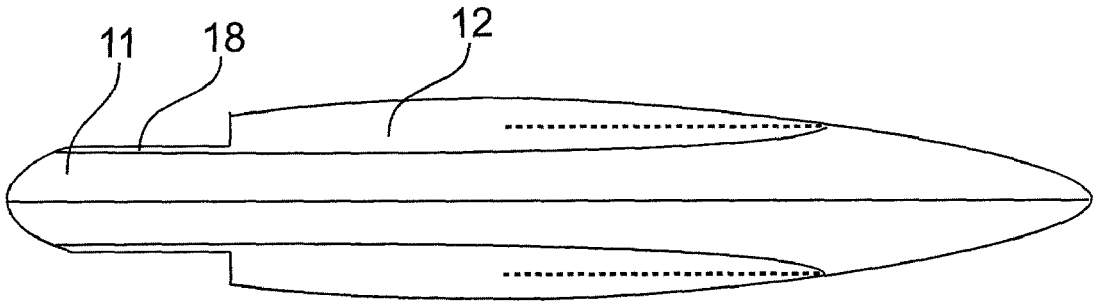
Figure 5C:
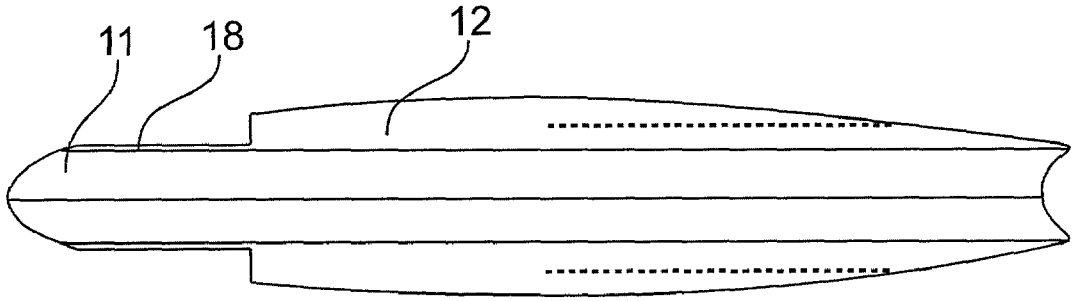
Figure 6A:
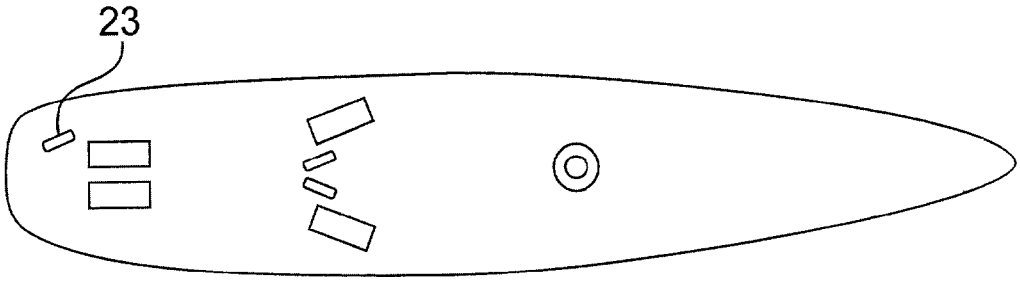
Figure 6B:
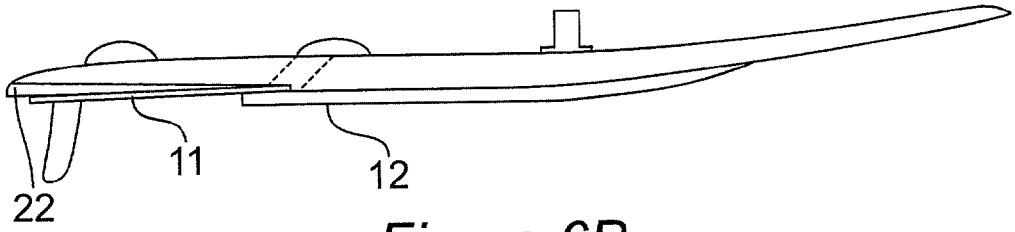
Figure 6C:
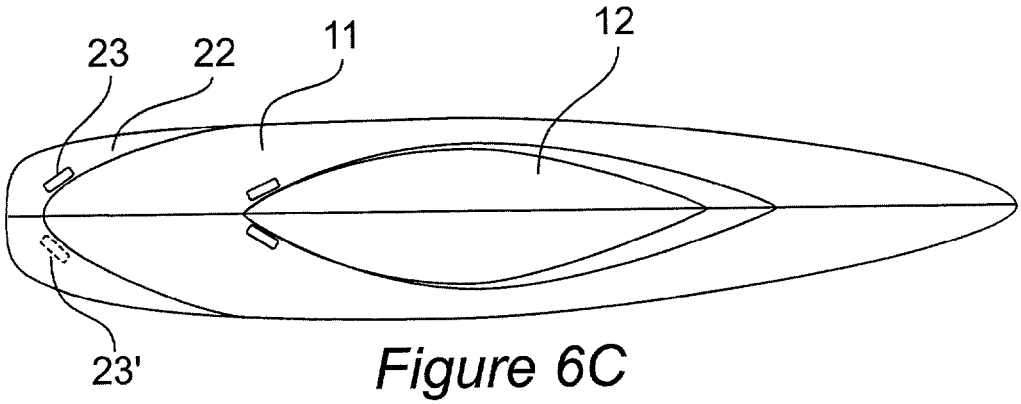
Figure 7A:
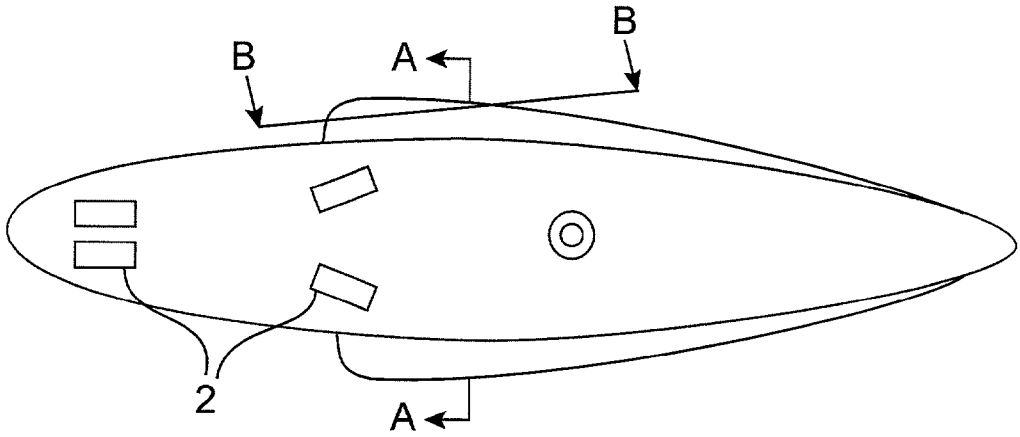
Figure 7B:
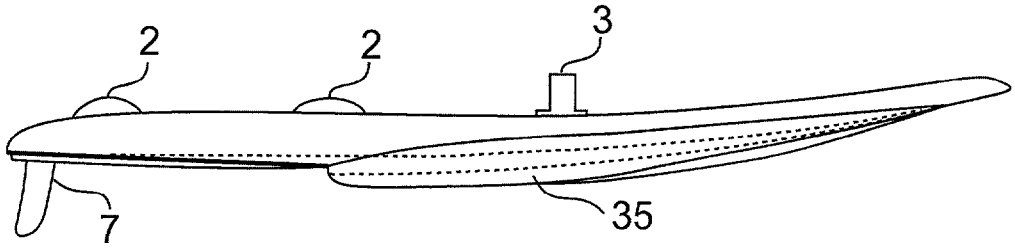
Figure 7C:
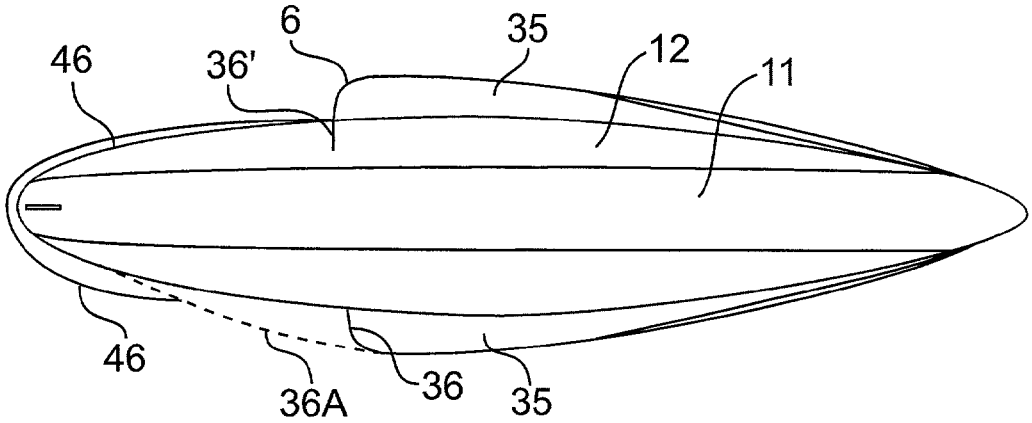
Figure 7D:
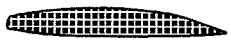
Figure 7E:
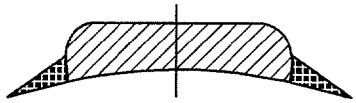
Figure 8A:
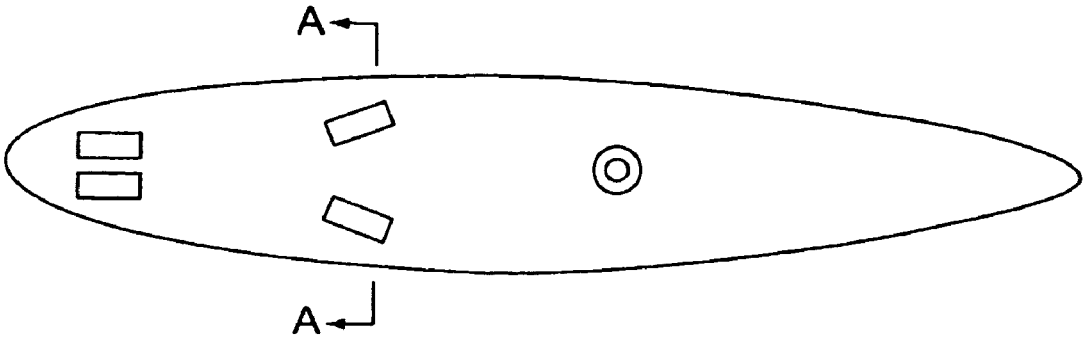
Figure 8B:
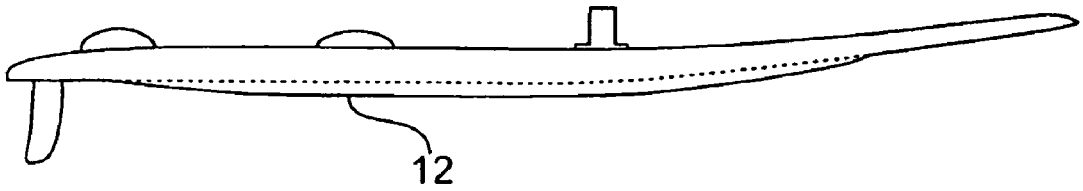
Figure 8C:
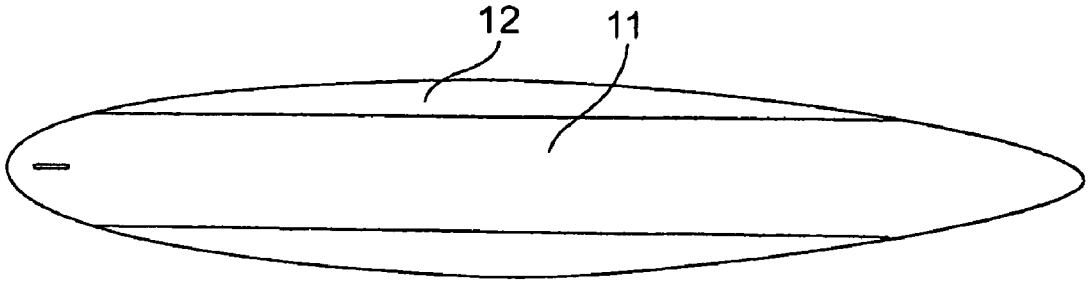
Figure 8D:
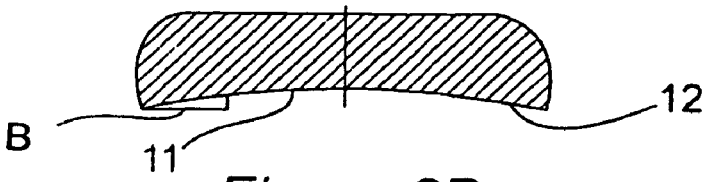
Figure 8E:
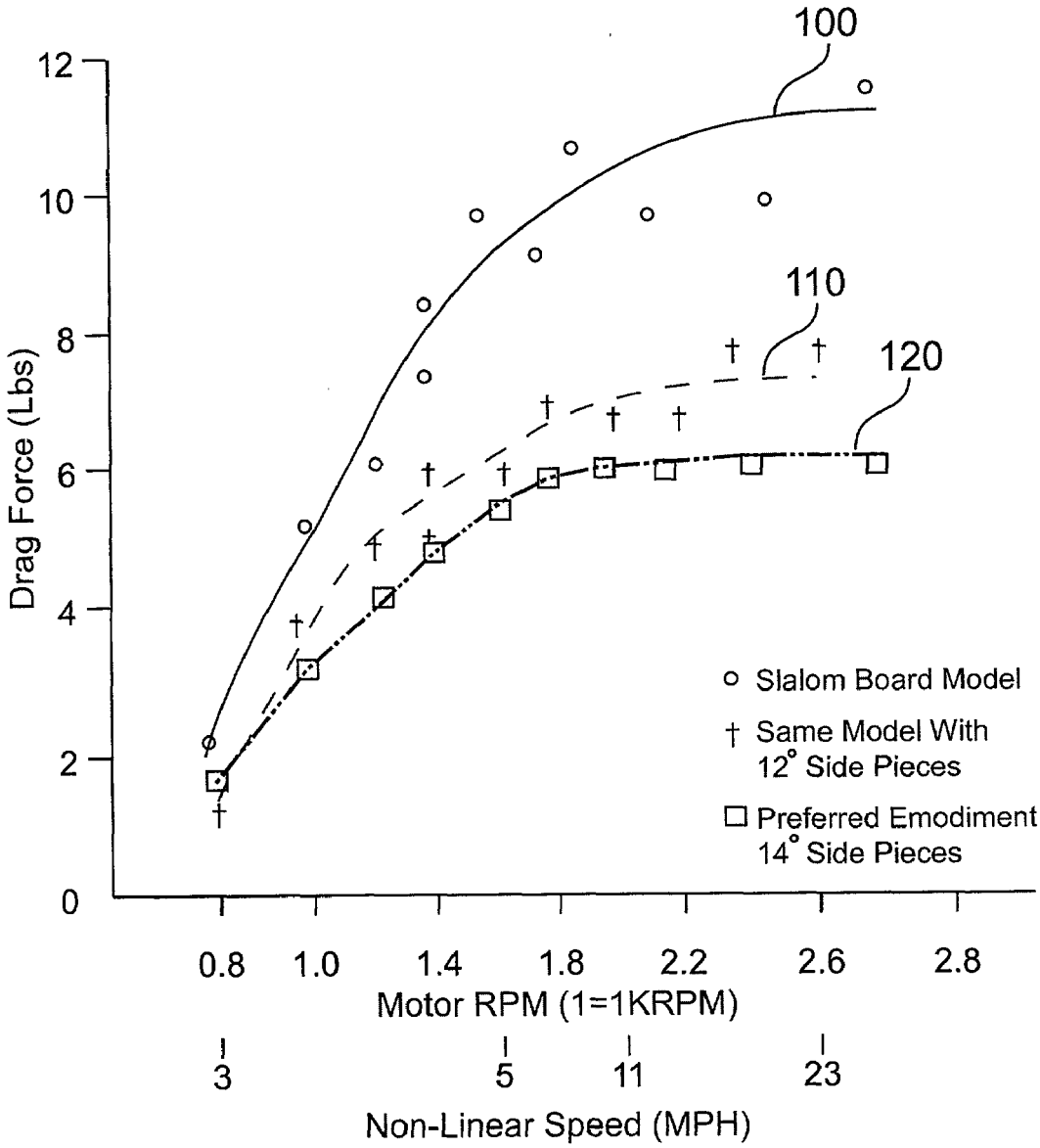
Figure 8F:
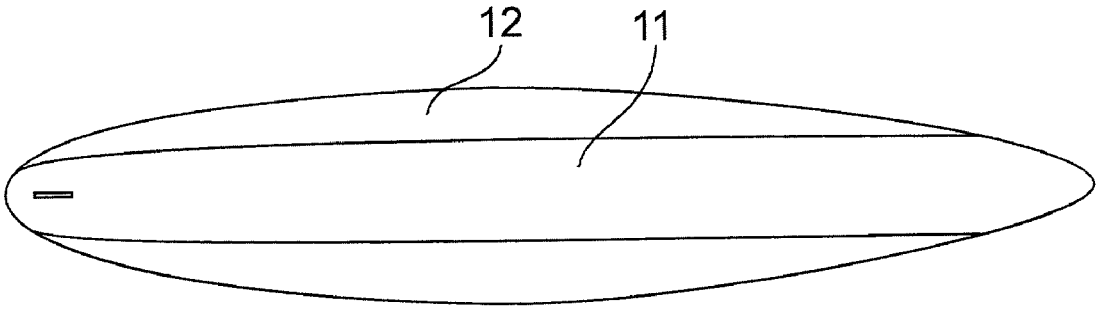
Figure 9A:
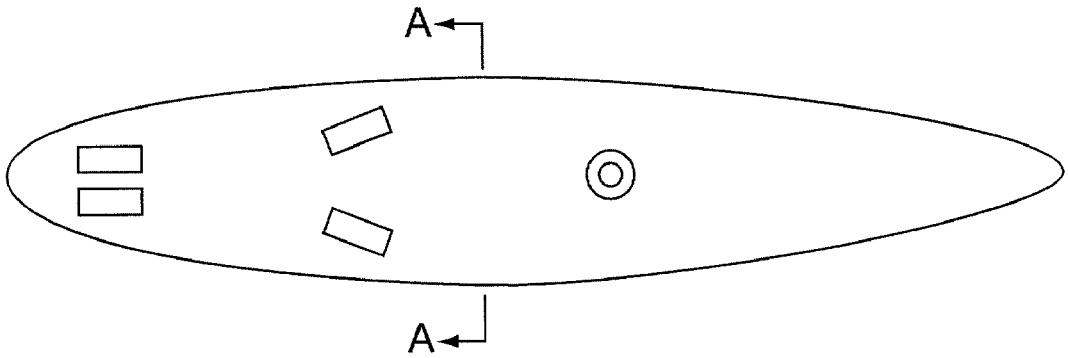
Figure 9B:
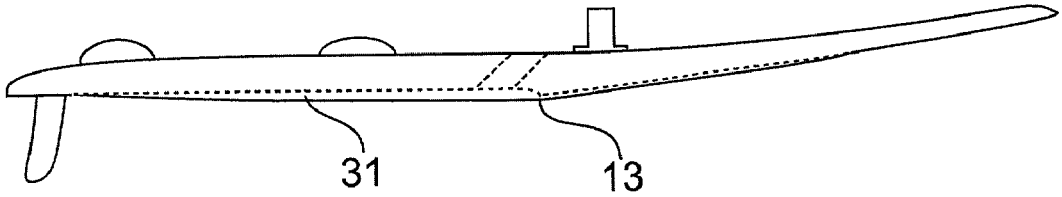
Figure 9C:
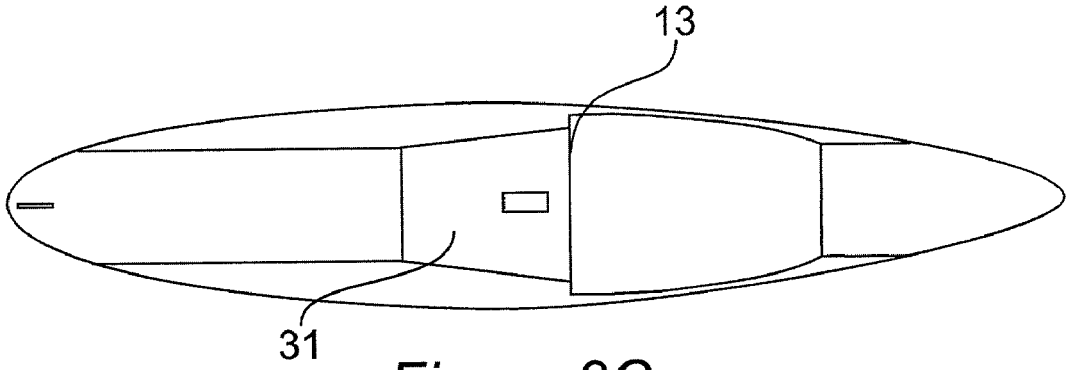
Figure 9D:
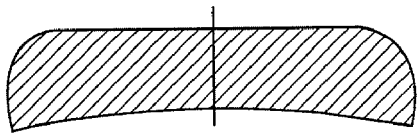
Figure 10A:
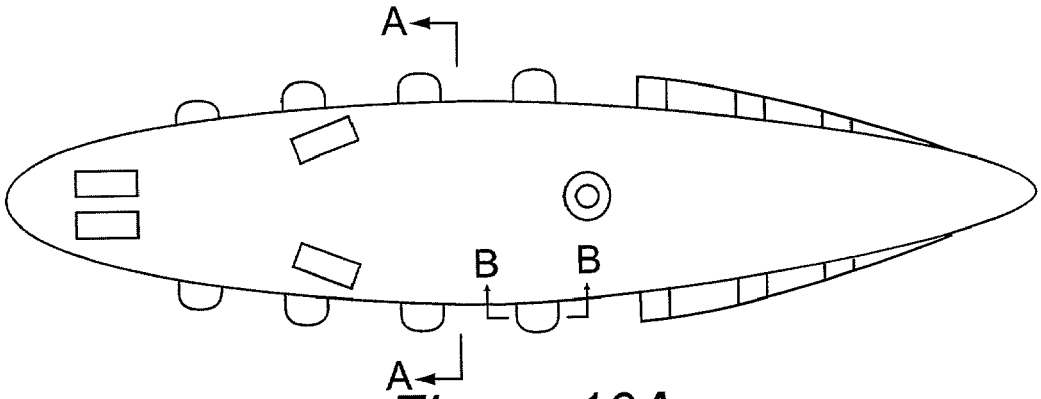
Figure 10B:
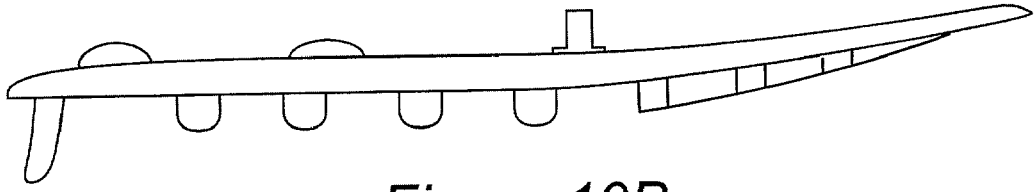
Figure 10C:
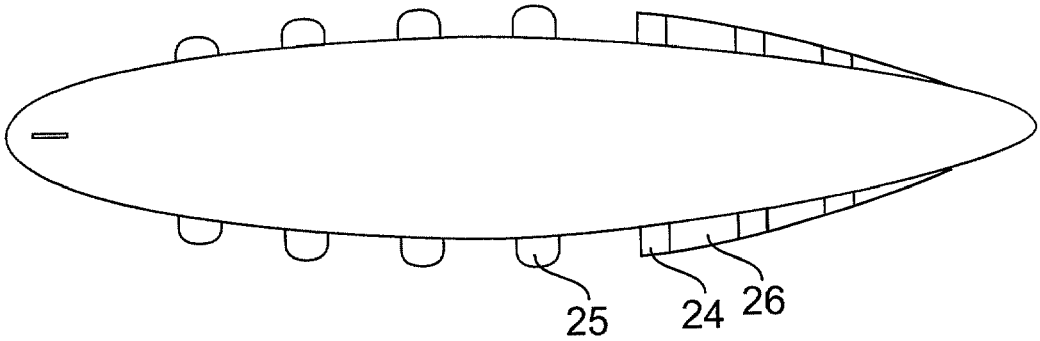
Figure 10D:
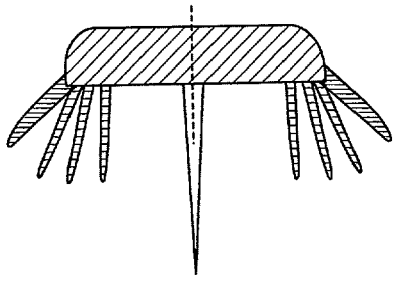
Figure 10E:
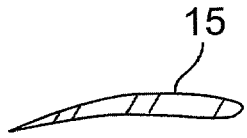
Figure 11A:
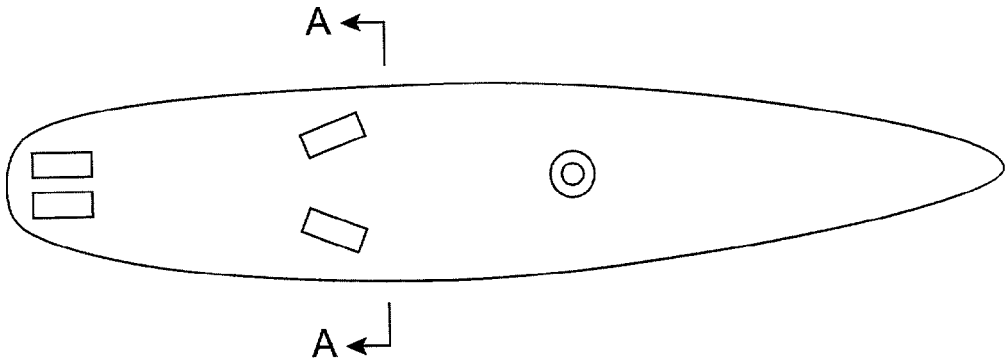
Figure 11B:
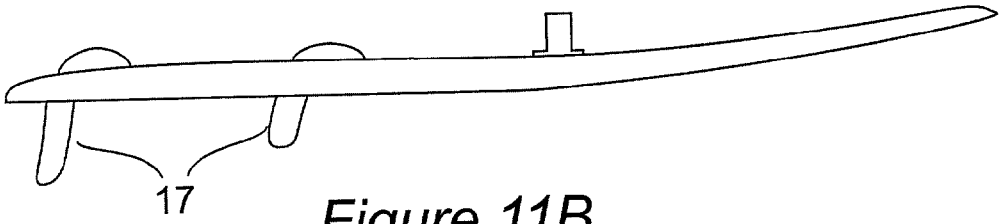
Figure 11C:
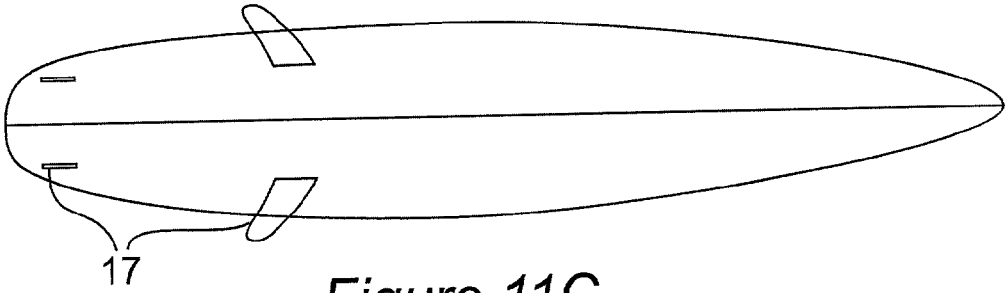
Figure 11D:
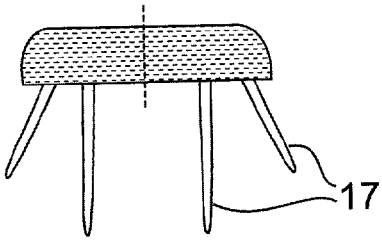

The foregoing and other objects, aspects and advantages will be better understood from the following detailed description of a preferred embodiment of the invention with reference to the drawings, in which;

FIGS. 1A, 1B and 1C are generalized top, side and bottom views, respectively, of a sailboard without features in accordance with the invention, FIGS. 2A, 2B and 2C are top, side (with cross-section) and bottom views, respectively, of a sailboard in accordance with a first embodiment of the invention having one second planing surface, FIGS. 3A, 3B and 3C are top, side (with cross-section) and bottom views, respectively, of a sailboard in accordance with a first embodiment of the invention including a tunnel or groove in the second planing surface, FIGS. 4A, 4B and 4C are top, side (with cross-section) and bottom views, respectively, of a sailboard in accordance with a first embodiment of the invention having two second planing surfaces feathered in to the first planing surface, FIGS. 5A, 5B and 5C are bottom views (with cross-section in FIG. 5B) of sailboard hulls in accordance with variant embodiments of the invention having two second planing surfaces feathered in to the first planing surface, FIGS. 6A, 6B and 6C are top, side and bottom views, respectively, of a sailboard in accordance with a first embodiment of the invention having two additional planing surfaces, FIGS. 7A, 7B, 7C, 7D and 7E are top, side, bottom and cross-sectional views of the hull and winglet, respectively, of the preferred embodiment of the invention, FIGS. 8A, 8B, 8C and 8D are top, side, bottom and cross-sectional views of a sailboard having downwardly angled sides and bottom surface in accordance with the invention, FIG. 8E is a graphical depiction of drag as a function of non-linearly scaled speed of the embodiment of FIGS. 7A-7D and FIGS. 8A-8D compared with a conventional slalom board derived from tests with models, FIG. 8F is a bottom view of a variant form of the embodiment of FIGS. 8A-8D with angled sides being curved from front to back, FIGS. 9A, 9B, 9C and 9D are top, side, bottom and cross-sectional views of a sailboard having downwardly angled sides and bottom surface including a second planing surface with a step and a streamlined surface behind the step in accordance with another embodiment of the invention, FIGS. 10A, 10B, 10C, 10D and 10E are top, side, bottom and cross-sectional views of a sailboard and winglet of a sailboard hull having a wing-grid or winglets in accordance with a further embodiment of the invention, FIGS. 11A, 11B, 11C and 11D are top, side, bottom and cross-sectional views of a sailboard having plural sets of fins or foils in accordance with yet another embodiment of the invention.

Figure 12A:
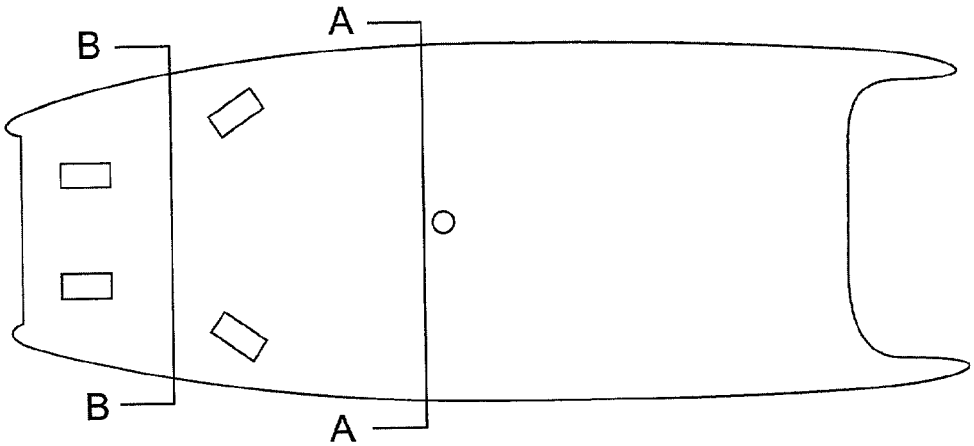
Figure 12B:
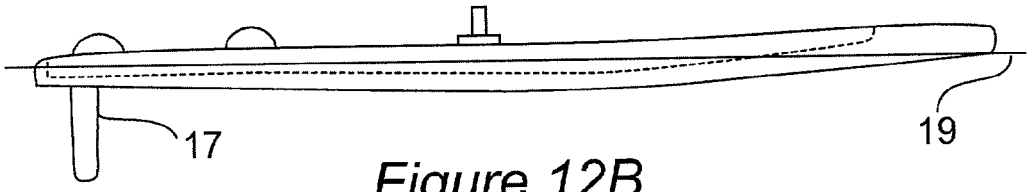
Figure 12C:
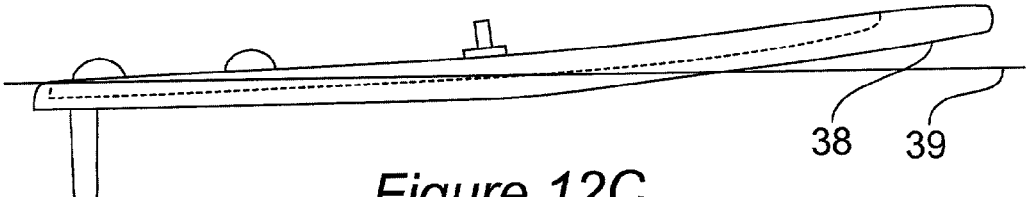
Figure 12D:
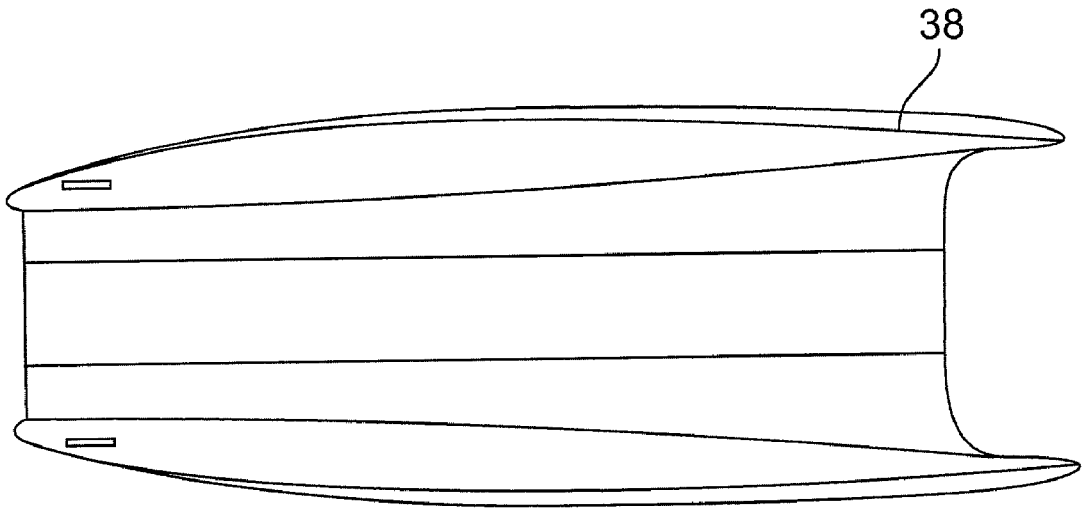
Figure 13A:
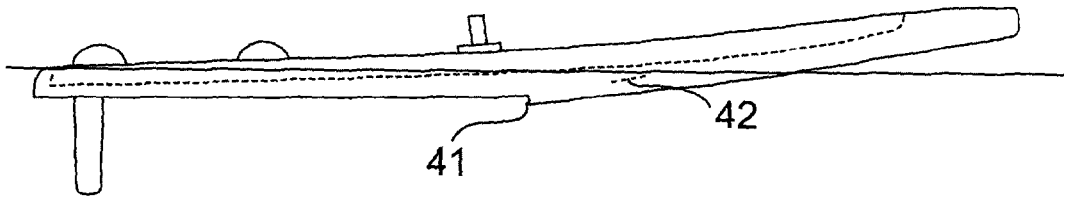
Figure 13B:
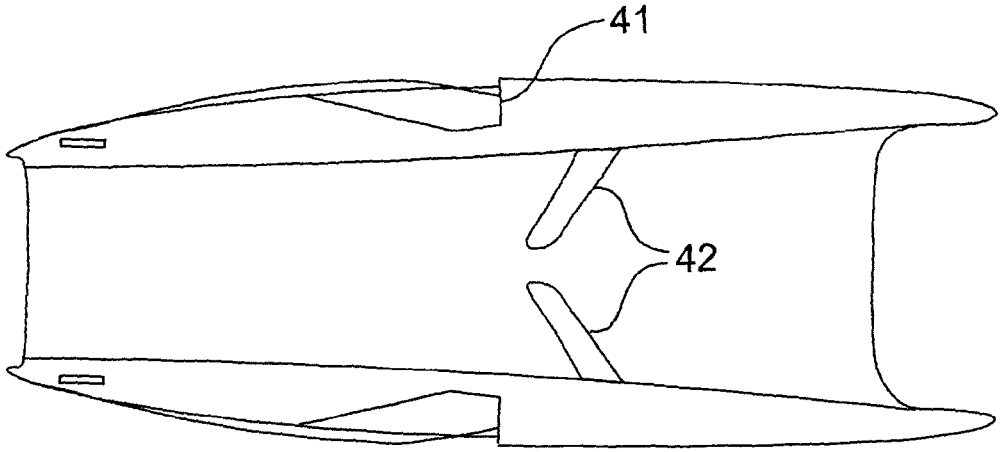
Figure 14A:
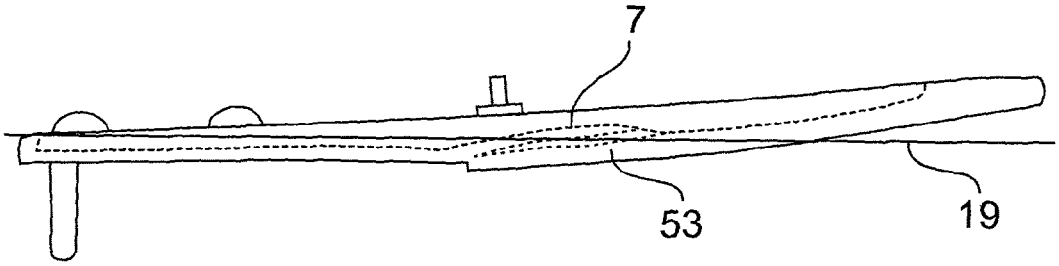
Figure 14B:
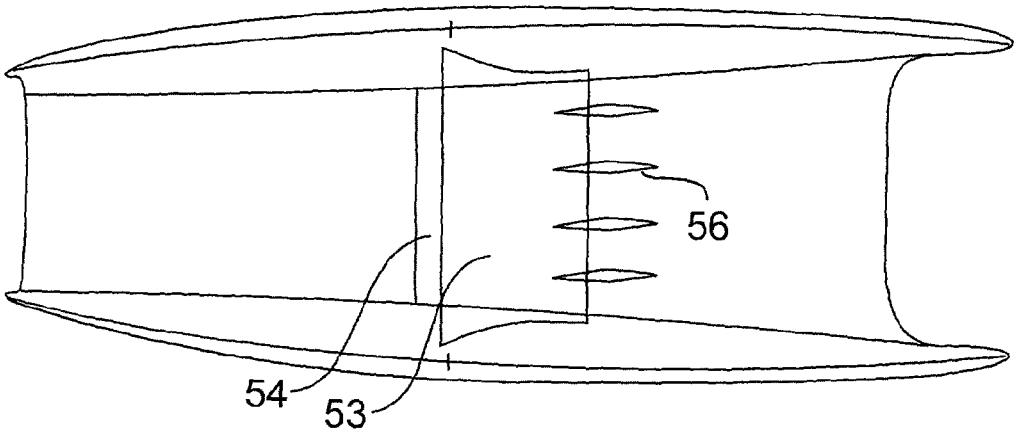

FIGS. 12A, 12B, 12C and 12D are top, side, bottom and cross-sectional views of a sailboard having wing fences that have significant displacement in accordance with a yet further embodiment of the invention, FIGS. 13A and 13B are a side view in planing orientation and bottom view, respectively, of a sailboard with a step in the fences and foils between the fences, combining features of several of the above embodiments of the invention, FIGS. 14A and 14B are a side view in planing orientation and bottom view, respectively, of a sailboard with a foil and ventilated step built into the board, combining features of several of the above embodiments of the invention, and FIGS. 15A, 15B, 15C and 15D are top, side, bottom and cross-sectional views of a preferred form of a slalom sailboard having a built-in foil and ventilated step in accordance with a further embodiment of the invention.

DETAILED DESCRIPTION OF A PREFERRED EMBODIMENT OF THE INVENTION

Referring now to the drawings, and more particularly to FIGS. 1A-1C, there is shown top, side and bottom views, respectively, of a generalized sailboard hull 1 which, for reference, does not include features in accordance with the invention in its various forms and embodiments. Since FIGS. 1A-1C are generalized and arranged for illustrative purposes, however, no portion of these Figures is admitted to be prior art as to the present invention. The overall shape in the top or plan view of FIG. 1A is generally elliptical but may be slightly more pointed at the front or rear. Foot straps 2 and a sail or mast foot (generally gimballed) are installed on the upper surface of the hull as shown in FIGS. 1A and 1B. A gentle upward curve or "rocker" is illustrated in the side view of FIG. 1B at reference numeral 5. A fin 7 is shown extending from the bottom surface 11 of the board in the side and bottom views of FIGS. 1B and 1C. The bottom side of the board, as shown in FIG. 1C, is also shaped in the form of a very shallow "V" as is sometimes a feature of commercially available sailboards.

FIGS. 2A-2C illustrate a first embodiment of the invention having a second planing layer or surface feathered in to the bottom surface of the board. The top surface is substantially the same as in FIG. 1A including foot straps 2 and mast fool 3 except for the inclusion of vents 13 which will be discussed in greater detail below. For clarity, the rocker is illustrated as similar to that of FIG. 1B but may be varied substantially without departing from the basic principles of the invention. Similarly, fin 7 is depicted as similar to that of FIGS. 1B and 1C but may be varied and, in any event, the particular shape, area and other features thereof are unimportant to the invention.

Accordingly, planing surface 11 may be regarded as substantially the same as that of FIGS. 1B and 1C but has a second planing surface 12 protruding downwardly therefrom as is particularly evident from the cross-section included in FIG. 2B. The front end of surface 12 is faired or feathered in to the surface 11 at the front end thereof but forms a step 15 at the rear. Even though surface 12 is elongated front-to-rear and substantially streamlined, the inventor has discovered and experimentally confirmed that even streamlined steps such as step 15 cause suction and drag in the region immediately behind the stop when the hull is in motion on the water unless the step is vented. This suction may be substantially greater than may be evident from a drawing such as FIG. 1C since, in a sail-powered vessel, there will inevitably be some side-slip or difference between the axis of the hull and the direction of water flow unless the hull is sailed directly before (e.g. in exactly the same direction as) the wind.

Accordingly, vents 13 are provided on opposite sides of surface 12 at the rear thereof adjacent step 15 and allow air to be pulled in behind the step 15 to eliminate the suction and drag. This air also mixes with the water and the fine bubbles thus formed further reduces the skin drag on surfaces 11. Any number and/or configuration of vents may be used and the vents may be covered by more of less open webbing or perforated sheet material at the top and/or bottom surfaces as may be desired. While webbing or perforated sheet material on the top surface may be largely cosmetic, webbing or, preferably, perforated sheet material which is also relatively rigid on the bottom side of the vents may reduce turbulence of the flow of water and enhance mixing of water and air; both of which tend to further reduce drag beyond the substantial elimination of suction at the step 15. Preferably, the area of these vents should be 10 $cm^2$ or larger (particularly if the path of the vent is elongated such as by passing diagonally through the board) to effectively reduce suction.

While some streamlining of surface 12 is considered desirable and of substantial importance to the development of the meritorious effects of the invention, it should be understood that such streamlining is not at all critical thereto and may be widely varied to adjust hull behavior within the basic principles of the invention. For example, if the front and rear ends of surface 12 are kept more parallel over a greater length than is shown in FIG. 2B, the effect of a "shoe keel" to limit sideslip may be somewhat enhanced. Planing may also be enhanced by increase of the area of surface 12 toward the rear with a more abruptly tapered or squared off shape.

It should be appreciated that the surface 12 presents a much smaller wetted area when planing than surface 11 of FIG. 1C. Therefore, the provision of the additional planing surface 12 can provide a shorter and wider surface favoring planing while surface 12 is more long and narrow favoring performance in the displacement mode. At the displacement/planing transition, vents 13 avoid drag due to step 15 while further reducing drag (by air-water mixing) and power requirements to achieve planing.

Therefore, it is seen that the provision of a second planing surface in accordance with the invention allows decoupling of design considerations for operation in the displacement and planing modes and higher performance to be achieved in each; thus accommodating a wider range of wind and water conditions. Venting of the step greatly smooths the displacement/planing transition and allows planing to be achieved in lighter winds and, further, allowing exploitation of virtual wind for much increased speed with much less power.

As a further perfecting feature of the embodiment of FIGS. 2A-2C, surface 12 can be slightly shaped downwardly as shown at 16*a* of FIGS. 2B and 2C. This shaping to form a slight downward concavity or cusp tends to increase the angle of attack at the end of the surface and to increase lift while planing. Since this region is close to the center of gravity of the board, fore and aft pitching or porpoising, as described above, is not engendered. Limitation of angle of attack at the displacement/planing transition can also be limited by similar shaping at 16*b* to further limit the power required to achieve planing. Surface 16*b* will then increase lift to drag ratio when planing is achieved and porpoising does not occur due to the stability of attack angle produced by surface 12. These cusps or other trim adjusting arrangements require no control by the operator and yet provide negative rocker, effectively flattening the hull and reducing drag, as speed increases thus effectively increasing the range of conditions over which high and enhanced performance can be achieved.

Such structures cannot be provided or such effects achieved in regard to a single bottom surface of the hull without causing porpoising effects and increase of criticality of conditions to performance. However, since the invention provides two different bottom surfaces ending at different locations, such shaping can be employed to simultaneously increase lift and reduce drag both while planing and within the displacement/planing transition.

As further perfecting features of the invention, may also be shaped in the lateral direction as shown in FIG. 2C and/or ridges or grooves 17 can be provided to increase the effective aspect ratio of surfaces 11 and/or 12 and further limit side slip. The effective increase in aspect ratio also increases the lift to drag ratio to further increase speed for given wind and water conditions.

Referring now to FIGS. 3A-3C, a variant form and further perfecting feature of surface 12 is shown. Specifically, a groove 19 is provided to partially or completely fair the central region of surface 12 back to surface 11. Functionally, the depth of groove 19 should be such that when the hull/board is planing at an angle of 2° to 3°, no portion of the second planing surface 12 which is directly in front of fin 7 will be below the level where the fin 7 meets the surface 11 of the board. This effect further functions to limit side slip by increasing the area of lateral surfaces and, more importantly, reduces or prevents cavitation of the fin in the water and thus avoids drag and spinout (when the fin cavitates) that would otherwise occur.

A variant form of the invention is shown in FIGS. 4A-4C in which two surfaces 12 are provided and the step 15 has been feathered out or faired in to the surface 11. In such a case, it is somewhat less important to ventilate the juncture of surfaces 11 and 12 with vents 13 but some performance improvement will be achieved if such vents are provided. This variant form of the invention may be regarded as a simplification of the embodiment of FIGS. 2A-2C and is somewhat more suited to operation for a greater percentage of time in a non-planing mode or non-planing conditions. The vertical distance between the surfaces 11 and 12 is preferably greater than one-half inch (the size of the step of the PRO-tect C. A. T. board alluded to above) and more preferably in the range of 1.0 to 2.5 inches to maintain a good angle of attack and stability thereof. Side-slip is limited by the increased lateral area surrounding surfaces 12 and the recess area 11 between area 12 improves directional control which may or may not be considered desirable.

FIGS. 5A-5C show further variant forms of the invention corresponding to the embodiment of FIGS. 4A-4C but including some features generally corresponding to the embodiment of FIGS. 2A-2C or additional perfecting features. FIG. 5A allows that two or more surfaces 12 can be provided and that ridges 18 may be used to form tunnel 28. A third surface 12 may be added centrally of the hull and/or additional surfaces 12 may be added in pairs. Surfaces 12 and 18 may be blended to form a more streamlined shape or squared off more nearly perpendicular to the hull axis, as shown in FIG. 5B. It is preferred to include vents 13, as shown, at step 15. Also, as shown in FIGS. 5B and 5C, step 15 may be fully ventilated by a vent that penetrates to (e.g. FIGS. 5B and 5C) or through (e.g. FIG. 2C) the top of the board or to the side of the board where the step extends above the water line (as shown in FIG. 2C or 5A which may be supplemented by vents through the board, if desired). It is also possible to add additional steps 15 along the length of surfaces 12 and any or all of such steps may be shaped with cusps 16*a*. Cusp shape 16*b* can also be included on surface 11.

Tunnel 28 also provides additional air and water lift and the forward region may be truncated as shown in FIG. 5C to reduce the likelihood that the hull will become airborne except when intended. Softer riding in chop will be achieved if the front ends of surfaces 12 are slightly V-shaped as illustrated by dotted lines in FIG. 5C.

FIGS. 6A-6C illustrates the perfecting feature of providing a further planing surface 22 recessed from surface 11 by a small step which is also preferably vented by vent 23. Plural vents such as 23' can be symmetrically or asymmetrically provided. Surface 22 provides additional lift by both buoyancy and planing at low wind when more lifting surface is generally desirable and further extends the range of conditions under which high performance can be achieved. However, surface 22 has a smaller attack angle or is short enough that in higher wind it is lifted out of the water. In addition, when surface 22 is out of the water, the position of the net lifting force will move forward, thus stabilizing the attack angle at an optimum and value over an increased range of speeds and achieving a larger planing surface at low speeds.

In view of the foregoing, it is seen that the invention provides for enhanced performance over a much wider range of wind and water conditions than has heretofore been possible. Further, the displacement/planing transition is made much less difficult and planing operation can be achieved with much lower power than with other designs. Angle of attack is stabilized at near optimum values over a wide range of hull speeds.

The above embodiments of the invention and perfecting features represent a substantial improvement in performance over the prior art largely by providing a significant change in aspect ratio of the wetted surface of the sailboard under planing conditions compared with displacement mode conditions. The change in physical aspect ratio of the board under planing conditions cannot, however, be significantly increased further without compromising the amount of planing area that provides lift. Further, drag in both the displacement and planing modes remains relatively great and decreases acceleration to planing speed. While, as alluded to above, it is known to increase the effective aspect ratio of a wing having flow over both top and bottom surfaces by the use of fences, tip plates and the like, no technique of producing a similar effect with a planing surface at a gas/fluid interface is known and structures capable of extending known techniques to a planing surface at a gas/fluid interface are not at all intuitive, particularly consistent with reducing or even avoiding increase in drag.

The inventor has discovered that the coefficient of lift of a planing flat plate at a gas/fluid interface can be expressed by an equation similar to Prandtl's equation discussed above. Specifically, the coefficient of lift for a flat plate planing on water can be expressed as $$C_L \cong 0.7\pi\alpha/(1+2/AR)$$

This equation tends to confirm the above-discussed effects of aspect ratio on planing lift of a sailboard and the smoothness of transition between planing and displacement modes of operation on a hull shape. The inventor has further deduced that induced drag from trailing vortices is a major component of total drag at higher displacement and near-planing speeds and that effective aspect ratio may be increased above the physical aspect ratio of the wetted surface by an appropriate hull shape which is effective to reduce the trailing vortices while increasing the coefficient of lift at a given speed by increasing effective aspect ratio beyond the physical aspect ratio during planing. Further, the inventor has deduced that the reduction in drag is a reliable indicator and possibly a quantitative measure of the increase of effective aspect ratio of the hull, when planing, and the additional lift resulting therefrom. The inventor has thus investigated the capacity of various hull shapes and features to perform such a function as will now be discussed in regard to the following embodiments of the invention and variant forms thereof.

The inventor has also noted that trailing vortices are generated in pairs near the sides of the hull and rotate is opposite directions. The inventor has thus theorized that structures which tend to reduce the magnitude of pairs of trailing vortices will reduce induced drag. That is, confining lateral outflow of water from under the planing surface will tend to increase effective aspect ratio and lift while reducing drag, as well. As will be discussed below, the hull shapes in accordance with the invention which are deemed successful achieve an unexpected degree of these effects.

The preferred embodiment of the invention is shown in FIGS. 7A-7E and has proven to provide the best overall performance achieved to date by a synergistic combination of features which are also well-balanced to provide additional desirable characteristics. These individual features and other synergistic combinations thereof will be discussed below as variant forms, embodiments and perfecting features of the invention.

The underlying goal of the intention is to increase the lift to drag ratio at all speeds while improving the smoothness of the change in lift to drag ratio through the transition from displacement mode to planing mode and without compromise of other characteristics (e.g. such as are referred to by terms such as "handling" and "ride" and the range of water and wind conditions for which a design is suitable). The lift to drag ratio can be increased by increasing lift, decreasing drag or some combination of both while the complexity of the relationship between lift and drag may make it difficult to quantitatively determine the relative contributions to overall performance from increased lift and reduced drag, individually. Thus, while the preferred embodiment of FIGS. 7A-7D is considered to provide the best performance achieved to date and the most marked improvement over other current and/or commercially available designs, it should be understood that the discussion of the designs shown in other Figures is provided not only to convey an understanding of the principles of the invention as theorized by the inventor at the present time (and by which the inventor does not wish to be bound, even though largely confirmed by experiments) but to be illustrative of other techniques and approaches to increasing the lift to drag ratio of a sailboard by individual features and combinations of features which may be preferred in certain circumstances and applications and to convey the full scope of the subject matter regarded as the invention.

The preferred embodiment of the invention as shown in FIGS. 7A-7E includes a downwardly curved or angled bottom surface 12 which provides about 30% less drag when planing, as shown in curve 120 of FIG. 8E as compared with curve 100. The ends of the curved surface 12 form winglets 35 angled downwardly to reach a maximum angle B in the range of 10° to 35° in the transverse direction and preferably of approximately 14° to the horizontal which contribute to lift both when planing and not planing (since they provide additional displacement). The preferred width of the winglets is preferably in the range of two inches to seven inches or more. The downward angling of the winglets and the downward curvature of surface 12 bring the depth of the winglet tips to about 1.5 inches or more below the centerline of surface 11.

These winglets are tapered at the rear to a very small thickness and present very little drag. The rear of the winglet may be either faired into the hull at a greater or lesser angle as shown at 36, 36*a* or formed as a step as shown at 36' (as alternative forms of the preferred embodiment), particularly if angled downwardly for very fast planing boards as will be discussed below. In either case, the rear of the winglet functions as a step and is fully ventilated to the side of the board above the water surface. The front of winglet 35 can be rounded on the bottom or angled to provide a softer chine in order to make the board easier to turn, especially when not planing.

The termination of the winglet is located in front of the center of gravity of the user/operator as located by the foot straps, preferably near the location of the front foot, and behing the mast gimbal. The lift from the winglets 35 allows the user/sailboarder to maintain the board at an optimum angle of attack of 4° to 7° when the board is fully planing. When the board is not planing, most of the winglet is in the water with water flowing on both sides; engendering both wing lift and displacement lift while being streamlined and having very little drag and enhancing lift of the remainder of the board.

As the board planes faster or becomes more fully planing, only the bottom portion of the winglets (and the rear portion of the hull) will be in the water. Since the winglets are angled downwardly, the steps will be approximately at the same depth as the center of the rear of the planing surface 11 or 12 when at the proper attack angle. Thus the area of the winglets near the steps and the area of the back planing surface will become smaller as the board speed and apparent wind speed becomes faster.

The angle of attack may be adjusted and the wetted area when planing further reduced by providing a small step 46 on the back and sides of the rear planing surface; making the surface smaller when planing and more streamlined and providing additional displacement lift when not planing. The height of this step can be as small as one-quarter to one-half inch and the surface behind the step may be angled upwardly by approximately 6° or more (generally corresponding to or slightly exceeding the desired angle of attack when planing) to improve venting of the step, to provide a more smooth transition of wetted hull shape at the displacement/planing transition and to avoid contacting the water when the board is planing at the proper angle of attack. The width of the step is not critical to the practice of the invention and may be varied, for example, if a single long fin (e.g. 70 cm) is desired, the step may be wide so that the top back surface of the board is wide and the foot straps and their attachment arrangements can be spread apart to prevent railing. This step is somewhat similar to that of some commercially available sailboards except that it preferably is extends farther along the sides of the rear planing surface.

For very fast boards, the inside of the winglets may be angled downwardly in a direction parallel to the board axis near the back of the winglets. This will reduce the transverse angle at the rear of the winglet and increases the aspect ratio, AR, of the winglets when essentially only the winglets and the back of the board is in the water. This can be done by providing more rocker in the outside of surface 12 at a location near the steps. That is, the outside 12' of surface 12 would curve down in a front to back direction in front of the step and upward in back of the step. Likewise, the outside of surface 12 can curve downward in front of the steps 6 and the rear edge 36' of winglets 35 can continue across part or all of surface 12 as shown in right side of the board in FIG. 7C.

This preferred embodiment of the sailboard in accordance with the invention has superior characteristics in comparison with known designs over a very wide range of wind speeds and water conditions. The board is streamlined and fast when not planing and derives enhanced lift from winglet displacement as well as wing lift when not planing; resulting in increased acceleration and earlier planing and the capability for planing in very low wind of about six miles per hour or less. The lift when planing is greater than conventional designs and planing can be maintained during lulls in the wind. Optimum planing angle is easily maintained while planing and the planing area (wetted area when planing) decreases inversely with the square or the velocity; maintaining the drag nearly constant once the board is fully planing. This latter quality provides for much increased sailboard speed for a given wind speed compared with conventional designs.

While not at all critical to the practice of the invention, the preferred embodiment may have one or more fins 7 as will be discussed in greater detail in connection with the embodiment of FIGS. 10A-10D. If more than one fin is used, the rear of the board may be more squarely shaped over the approximate distance of the separation of the fins; allowing the fins to be closer to the rear of the board. Using multiple fins allows the fins to be shorter while having the same aspect ratio and total area. Multiple fins produce less torque so that the foot straps may be placed closer to the centerline of the board. The fins would be preferably symmetrically positioned about the centerline of the board and any fins not on the centerline may be curved or otherwise asymmetrically shaped to reduce water outflow from the bottom side of the board and thus increase the lift/drag ratio.

It should be noted that the features of the preferred embodiment of the invention which increase lift, as described above, also serve to reduce drag; yielding a large increase in lift to drag ratio. Specifically, the downward curving or angling of surface 12 in the transverse direction (which, together with rocker, forms a shallow "saddle" shape) also confines the outflow of water from under surface 12; thus reducing the magnitude of trailing vortices and drag and smoothly, increasing the effective aspect ratio change across the displacement/planing transition to a point well beyond the actual aspect ratio change of the wetted surface of the hull over a wide range of speed which is increased by the fact that drag becomes substantially constant regardless of speed once full planing is achieved.

Other approaches to increasing lift to drag ratio with hull features and combinations thereof will now be explained in connection with other embodiments of the invention and which will also serve to convey an understanding of the principles of the invention, as alluded to above. All of these approaches share the common characteristics of increasing lift while reducing drag, extending the effective aspect ratio of the board while planing beyond the actual geometry of the wetted surface of the hull, reducing outflow of water from under the planing surface and providing a smooth change in effective aspect ratio over a small and lowered speed range corresponding to the displacement/planing transition.

FIGS. 8A-8D show top, side, bottom and sectional views of a sailboard hull having sides of the bottom surface angled downwardly. In this embodiment, second planing surface 12 is curved or angled downwardly from first planing surface 11. This shape is somewhat similar to a commercially available sailboard hull except that the edges of the board extend only slightly below the depth of the board at the centerline and do not provide a significant amount of displacement whereas it is preferred that the edges of the board in accordance with the intention extend at least one inch and preferably substantially deeper than the centerline of the hull and, by so doing, provide displacement and lift while not planing. This shape reduces outflow of water laterally to the sides and increases lift and effective aspect ratio, AR, of the board. It is believed that the minimum transverse curvature for adequate confinement of water under planing surface 12 to simultaneously increase lift and reduce drag is about 0.03 times the maximum width of the board with about 0.06 to 0.08 times maximum board width being considered optimum. Since board widths range from about 50 cm to 100 cm (about 20 to 39 inches) and narrow boards may require somewhat more curvature for effective confinement, at least about three-quarters of an inch difference in depth of the surfaces at the edges and board centerline would be required for successful practice of the invention although the commercially available board noted above may achieve a small amount of drag reduction. Surfaces 12 may be spaced slightly wider in the front and narrower in the back and may also be curved from front to back as shown in FIG. 8F.

The inventor has experimentally shown, both on full size boards and 40% and 50% scale models that an angle, B, of about 15° on the outside of the bottom board surface also reduces drag by roughly 20%. In addition, the inventor has found that these angled surfaces engender an operational quality referred to as "lively" and make the board easy to turn. That is, the board is not excessively stable directionally as might be expected from the long, relatively narrow shape. Additionally the wind range where planing could be achieved was noticeably increased as a function of increased lift at a given wind speed which can develop the necessary lifting force with less wind and at lower speed.

Since the surfaces are highly streamlined but have significant volume, the board is comparatively faster than a conventional board in the displacement mode. Due to both the streamlining of surfaces 12 and the increased lift and reduced drag during planing (which also decreases with decrease of wetted area as planing speed increases) the board will be faster while planing at a given wind speed. In fact, if the board is operated at the optimum planing angle, the drag is substantially independent of speed once the board is fully planing rather than drag increasing with speed, as will be discussed below with reference to FIG. 8E.

FIG. 8E shows a plot of drag versus non-linearly scaled speed in experiments conducted by the Inventor. The data was, in fact, collected by direct measurement of towing force on a model towed by a boat with reference to propeller revolutions per minute which were then calibrated, as shown to derive a non-linear speed scale. The towed models in these experiments were 40% scale models with 16% of a typical load for a full-size board. It can be clearly seen from the data represented that a conventional slalom board exhibits drag which increases sharply with speed until planing is achieved and continues to increase with speed (but at a lower rate) in the planing mode. The "knee" of the curve is pronounced, indicative of a relatively sharp, displacement to planing transition. In contrast, the hull shape of FIGS. 8A-8D in accordance with the invention (differing from the conventional slalom board only by the inclusion of surface 12 at a maximum 12° downward angle exhibits substantially less drag at any given speed in displacement mode, a gentle transition to planing mode and little, if any, increase in drag with increasing speed. Therefore, the hull speed which can be achieved once planing is achieved is almost, if not completely, a function of wind speed and, to a lesser degree, sail efficiency. The drag exhibited by the hull in accordance with the invention is thus decreased compared to a conventional hull over the entire speed range relevant to sailboard operation and reduced by 20% at near planing and lower planing speeds which is unexpected and highly counterintuitive since the hull shapes differ only in the presence of absence of surface 12 which, when present, adds wetted surface area to the hull. If detectable at all, any increase in drag may thus be inferred to occur only at extremely low speeds where it is very small.

FIGS. 9A-9D shows a further variant form of the hull of FIGS. 8A-8D. In this variant form of the invention, the sides of the bottom surface are similarly angled downwardly but the second planing surface 11 includes a ventilated step 13 and a steamline tapered surface 31 behind the step. Step 13 makes the planing angle more stable at or near the optimum angle. Therefore, this hull shape requires less skill of the user to achieve and maintain near optimum performance.

FIGS. 10A-10D shows a further variant form of the sailboard hull in accordance with the invention which includes a wing-grid 24 with winglets 25. The wing grid can be angled downwardly at an angle from about 30° to 90° transverse to the centerline of the board, similar to angle B, preferably progressively, in order to reduce the lateral force on the front of the board by winglets 15 and may be closed on the outside by structure 26 so that no sharp edges will be presented near the front of the board. In addition, the wing-grid and winglets may be angled progressively downward from front to rear of the board to provide progressively more lateral lift than vertical lift while making the planing angle more stable to reduce required user skill. While more critical to the practice of the invention, the winglets are preferably thin and curved and should be largest near the middle of the board.

FIGS. 11A-11D show a sailboard hull having a plurality of fins or foils 17 in accordance with the invention but a more conventionally shaped bottom surface. These fins are used, as is the angled bottom surface in, for example, the embodiment of FIGS. 7A-7D, to reduce the outflow of water from under the planing surface to increase lift and effective aspect ratio of the board. Since this more conventional hull shape inherently produces an outflow of water which the fins or foils 17 reduce, these fins or foils may be asymmetric, particularly near the board bottom surface, and/or have curvature in the direction of slow similar to winglets 25 in the embodiment of FIGS. 10A-109D such that at zero angle of attack ($\alpha$=0°) there is a lift which reduces the outflow. The back set of fins or foils 17 can be nearly vertical while sets more forward may preferably have more lateral slope to reduce the lateral lift of the more forward sets. while increasing their vertical lift. As with previously described embodiments, this progressive change in angle and lift stabilizes the planing angle and requires less user skill to obtain good performance. The number of sets of fins or foils 17 can be varied from one pair of asymmetric fins or two pairs of fins, one symmetric pair and one asymmetric pair, to numbers comparable to the number of winglets 25 shown in the embodiment of FIGS. 10A-10D. It may also be useful in achieving good attack angle stability characteristics to maintain a near optimal attack angle over an extended range of speed to reduce the size of fins or foils toward the front of the board in order to reduce lateral force on the board. Fins may be angled backward to shed weeds and grass and increase directional stability.

If the angle of surface 12 in FIG. 8D is increased and the width of surface 12 reduced slightly it would more closely resemble a so-called fence on a wing or hydrofoil. FIGS. 12A-12D show a sailboard with fences 38. In addition, fences 38 may have sufficient volume that at low speed, their volume can be a significant portion of the displacement of the board. In such a case, if their length to width or depth ratio is in a range of about 10:1 to 20:1 (preferably about 14:1) they will have vanishingly small wave drag. When the board is planing, these fences will greatly increase the lift to drag ratio and the effective AR of the board. When planing, the front portion of the fences rises out of the water to further reduce wetted area. Further, if these fences are progressively angled inward near the back of the board, the outer surface would be free of the water when planing. Thus the transverse angle of the fence can be made less on the inside and greater on the outside (e.g. the cross-section of the fence is somewhat v-shaped and angled outwardly so that the outer surface faces slightly upward and the inner face faces diagonally downward) to reduce wetted surface area. It should be appreciated that such fences as well as winglets, wing grids and fins, particularly if angled, will present much the same types of surfaces for planing and provide or contribute to the amount of downward curvature or angling of the bottom surface of the board to effectively confine out flow of water from beneath the board as well as potentially providing lift.

The amount of reduction of drag depends of the board speed and the relative size of the fences. Larger fences with greater volume have lower drag at low displacement speed and smaller fences with lower volume have lower drag at higher planing speeds. However, in either case, it is important to minimize drag on the back of the fences as can be achieved in the above-described manner consistent with enhancing lift at both displacement, transitional and planing speeds using the cross-sectional shapes shown in FIG. 2E.

Figure 12E:
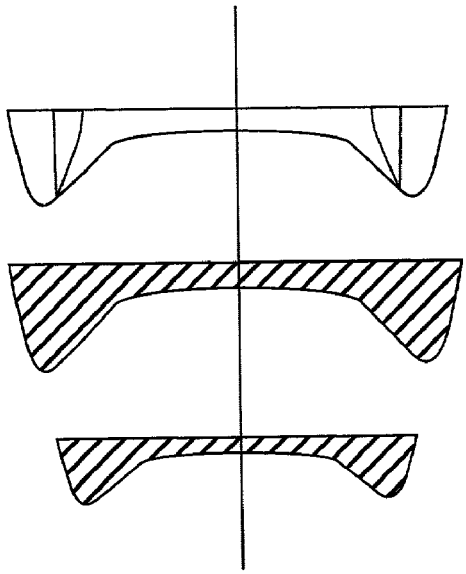

In a manner similar to the embodiment of FIGS. 8A-8D, the distance between the fences may be greater at the front of the board and narrower toward the rear and may have curvature from front to back in the manner of FIG. 8F to engender the same desirable qualities discussed above. FIGS. 12B and 12C show the respective displacement and planing attitudes of this embodiment of the invention with line 39 as the nominal water surface. It can readily be observed from a comparison of FIGS. 12B and 12C with the cross-sections of FIG. 12E that both effectively large, high volume fences at displacement speeds and narrow, low volume fences at planing speeds can be achieved while also achieving a smooth transition in effective aspect ratio with speed.

A number of the features having beneficial effects on lift, drag and effective aspect ratio can be combined with synergistic effect. For example, FIGS. 13A-13B shows sailboard hull with a step 41 in the fences and two optional foils 42 which are preferably thin and have substantial curvature. A thin and curved shape provides larger lift from the bottom surface to provide high lift even when planing and the top surface is ventilated. The attack angle in the displacement mode can be zero or the angle having the minimum drag of the foil curvature or cross-sectional shape in order to have minimum drag while still producing some degree of lift which would be increased as planing speeds and attitude are approached. The foils, particularly in combination with the step, stabilize the attack angle when planing so that an optimum angle of attack of 4° to 7° may be maintained. The backward raking illustrated is preferably in the range of 30° to 45° and is principally for avoiding collection of material such as seaweed or grasses but, in theory, may have beneficial effects on operating characteristics such as directional stability. The same is true for winglets 25 in other embodiments of the invention (e.g. FIGS. 10A-10D) described above. The spacing between the foils 42 is preferably small so that their effective AR is large. The foils 42 can also be angled downwardly and outwardly. Steps 21 serve to further reduce wetted surface area drag of the fences when planing.

FIGS. 14A-14B illustrate a sailboard hull having a foil 53 built into the board such that it forms a ventilated step. Ventilation can be provided from the area in front of the step so that the air or water can flow over the top of the foil (to provide additional lift when not planing) or it may be ventilated from the top or the sides. A grid arrangement 56 may be used to keep material from being collected on the front of the foil 23 and can the arranged to support the foil from the top to increase durability thereof as well as functioning in the nature of a wing fence on the foil to further increase the effective AR.

Figure 15A:
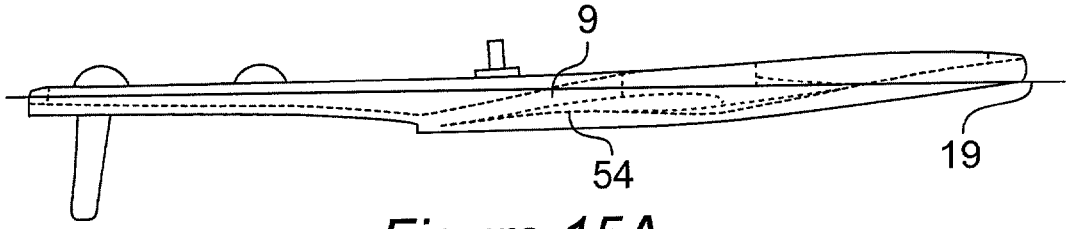
Figure 15B:
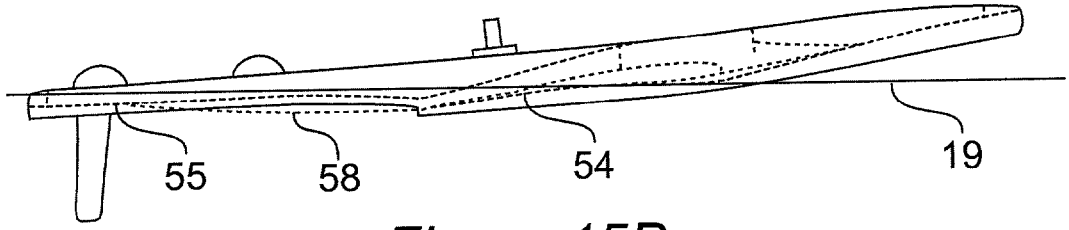
Figure 15C:
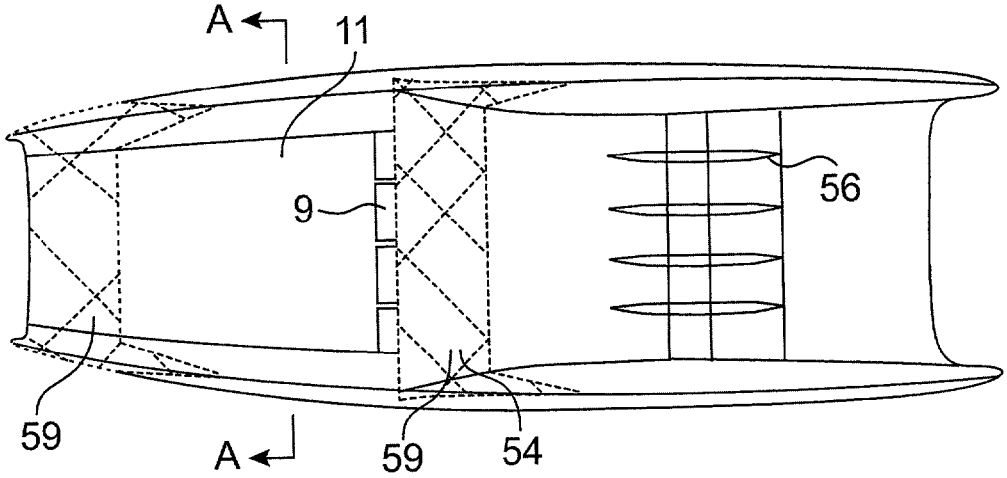
Figure 15D:
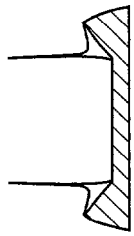

Combinations of features of boards described above can also be combined to accommodate higher wind conditions. For example, the embodiment shown in FIGS. 15A-15B provides smaller fences and/or curved bottom surfaces with one or more sets of fins to provide a slalom board. Cambered step 54 is similar to foil 53 except that it is intended to be only a cambered planing surface when the board is planing. The cambered step 54 may be ventilated by ventilation channel 9 from either the top of the board or the bottom of the board in front or to the side of the cambered surface. The cambered surface may be supported by grids 56 through the ventilation channel as described above.

The region of surface 11 immediately behind step 54 can be cambered (e.g. have curvature negative to that of the board's rocker). In such a case, the trim or attack angle to the water in this region will be less than that of the rear of the board to reduce drag when the board is not planing and the curvature is close to that of the water at low planing speeds. This curvature/streamlining can increase the lift and lift/drag ratio of the region behind the steps 51 and foil 53.

The cross-hatched areas 59 show the wetted surface for a particular speed and planing angle. The approximate water line of the wake behind step 54 is shown as water line 58. As the planing speed increases, the curvature of the water line decreases and the reattachment point moves to the back of planing surface 55. Thus as the planing speed increases, the wetted surface area and the aspect ratio are decreased by a greater amount than would otherwise occur while the angle of attack of the sailboard also increases. The fact that there are two planing surfaces also stabilizes the attack angle at near optimum for the particular speed. Thus, the cambered planing surface of cambered step 54 in combination with this effect produces low drag with high lift and hence an unusually increased lift/drag ratio while the curved surface 11 further reduces the drag and increases the lift. It is estimated that the drag reduction is on the order of 30% to 40%; close to what is considered to be the theoretical limit.

Another advantage of the fences or planing surface which protrudes down at the edge is that when a set of fins are used which extend from near the back of this fence or protrusion, the cavitation of the fins is reduced. This is because the top of the fin or region of the fin near the board is deeper in the water and thus more protected from the atmosphere or air.

It the interest of completeness of a description of the invention, it may be useful to an understanding of the invention and an appreciation of the meritorious effects thereof to consider the lift/drag ratio in terms of effective width of the board which provide a more generalized criteria for evaluation. Effective width can be defined as:

$$\text{Effective width} = \text{width} \times \frac{\text{enhanced lift/drag}}{\text{flat lift/drag}}$$

where the "flat lift/drag" is that for a planing board with a flat bottom surface and a given amount of surface area and trim angle and the "effective lift/drag" is the lift/drag ratio for the hull shape of interest of the same area and trim angle. It is desirable for the effective width between the location of the mast foot/gimbal and the front foot straps (which will be about 120 cm from the back of the board) to be at least 2.0 times the planing width 30 cm from the back of the board. The back planing width is normally flat and a measure of the planing width does not include width of a soft chine or a step such as step 46 (FIG. 7C) at the rear of the board. This ratio of effective width of surfaces at these two locations provides reduced drag in the displacement mode as well as in the planing mode.

As alluded to above, for faster boards, the downward angled of the edges of the board can be flattened somewhat through downward angling in the front to back direction at a location near the front foot strap while remaining sufficiently below the bottom surface at the centerline or central half of the surface width sufficient to confinement of lateral outflow of water and forming a step.

The ratio of these effective widths would be 1.5 for a half of an ellipse (e.g. a planing flat elliptic board with only the rear half being wetted surface area) and is generally in the range of 1.6 to 1.8 for known commercially available boards and may be as low as 1.3 for some boards that are of relatively wide design. Thus, recalling that effective width is defined in terms of an enhancement of lift/drag ratio referenced to a planing flat surface, an increase of this ratio of effective widths to 2.0 would represent at least a 10% improvement over known boards. Recalling also that the mechanism of planing causes the board to rise and the planing/wetted surface to be diminished until the planing lift equals the weight of the board and the load carried by it, the effective width can be expressed in terms of measured drag. Thus, the values indicated in FIG. 8E for the embodiment of FIGS. 7A-7D correspond to an effective width ratio of about 2.6, and clearly well above 2.2 (which would represent twice the improvement to achieve reduced drag in both the displacement and planing modes) indicating quantatively the large and unexpected nature of the is improvement in lift/drag ratio achieved by the invention and particularly the preferred embodiment thereof.

From the foregoing, it is seen that providing a downwardly curved or angled lower surface of a sailboard hull where the downward angle reaches about 10° or more or where the concavity of the cross-section is 0.03 times the board width or about three-quarters of an inch or more and/or at least one pair of asymmetrical fins, winglets or wing grid can sufficiently confine water under the planing surface of the sailboard hull to simultaneously reduce drag and increase lift; yielding a substantial increase in lift-to drag ratio. Lift can also be provided using hull shape features which function in the manner of fences which can be shaped to provide displacement lift and low drag at low speeds and to increase planing lift at higher speed with a smooth transition therebetween. Curvature and/or steps in the bottom of the board can further reduce surface area dramatically when planing while all of the features discussed above can be configured to stabilize angle of attack at an optimal value.

These features or curved or angled surfaces provide a second planing surface in addition to the first or main planing surface of the sailboard hull and provide alteration of aspect ratio of the wetted surface area with change of speed of the hull. In combination with the function of features which serve to confine water under the board, the effective aspect ratio can be changed beyond the geometry of the first and second planing surfaces to provide unexpectedly great increase in lift to drag ratio allowing planing at lower hull speed and lower wind speed, higher speed for a given wind speed and point of sail and the capability of sustaining improved performance over a wider range of wing and water conditions.

While the invention has been described in terms of a single preferred embodiment, those skilled in the art will recognize that the invention can be practiced with modification within the spirit and scope of the appended claims.

The invention claimed is:

1. A sailboard apparatus having a symmetric hull, a bottom planing surface, an arrangement for attaching foot straps including a front foot strap and a sail mast attachment arrangement, said bottom planing surface of said hull, in the planing mode, having an effective width at a first location between said sail mast attachment arrangement and said arrangement for attaching a front foot strap of said foot straps which is at least 2.2 times the width of the planing surface of said hull 20 cm from the rear of said hull wherein effective width at a location between said sail mast attachment arrangement and said arrangement for attaching said front foot strap is at least 2.4 times the effective width of the planing surface of said hull 20 cm from the rear of said hull.

2. A sailboard apparatus as recited in claim 1 wherein part of the sides of said hull form a step.

3. A sailboard apparatus having a symmetric hull, a bottom planing surface, an arrangement for attaching foot straps including a front foot strap and a sail mast attachment arrangement, said bottom planing surface of said sailboard, in the planing mode, having an effective width at a first location between said sail mast attachment arrangement and said arrangement for attaching a front foot strap of said foot straps which is at least 2.4 times the width of the planing surface of said hull at a second location located to the rear of said first location such that an actual width of said bottom planing surface at said first location is 1.5 times an actual width of said bottom planing surface at said second location.

* * * * *